US006996926B2

(12) United States Patent
Fatemi

(10) Patent No.: US 6,996,926 B2
(45) Date of Patent: Feb. 14, 2006

(54) ARM ASSEMBLY FOR EXCAVATION APPARATUS AND METHOD OF USING SAME

(75) Inventor: Ray S. Fatemi, Fairlawn, OH (US)

(73) Assignee: JRB Attachments, LLC, Cedar Rapids, IA (US)

( * ) Notice: Subject to any disclaimer, the term of this patent is extended or adjusted under 35 U.S.C. 154(b) by 28 days.

(21) Appl. No.: 10/601,727

(22) Filed: Jun. 23, 2003

(65) Prior Publication Data

US 2004/0000077 A1 Jan. 1, 2004

Related U.S. Application Data

(60) Provisional application No. 60/411,181, filed on Sep. 16, 2002, provisional application No. 60/391,062, filed on Jun. 24, 2002.

(51) Int. Cl.
*E02F 3/96* (2006.01)

(52) U.S. Cl. ..... 37/468; 414/723; 403/31; 403/322.1; 403/324

(58) Field of Classification Search ..... 37/403, 37/468, 231, 409, 404, 405, 406, 407, 408, 37/410; 172/272, 273, 235, 439, 450, 456; 414/423, 912, 723; 403/31, 320–326, 315
See application file for complete search history.

(56) References Cited

U.S. PATENT DOCUMENTS 5,581,917 A 12/1996 Barden ..... 37/468

(Continued)

FOREIGN PATENT DOCUMENTS

| | | |
|---|---|---|
| AU | B-186028/83 | 3/1984 |
| EP | 0 184 282 A1 | 6/1986 |
| EP | 0 468 771 A1 | 1/1992 |
| GB | 2 330 568 A | 4/1999 |
| JP | 11-181818 | 7/1999 |

(Continued)

*Primary Examiner*—Christopher J. Novosad
(74) *Attorney, Agent, or Firm*—Fay, Sharpe, Fagan, Minnich & McKee, LLP

(57) ABSTRACT

An arm assembly for an excavator includes an arm comprising a first hook including a first open mouth. The arm further includes a first pin capturing system that selectively obstructs the first open mouth. A link is movable relative to the arm and comprises a second hook including a second open mouth. The second open mouth is oriented toward the arm, and the link further comprises a second pin capturing system that selectively obstructs the second open mouth. The first and second pin assemblies of an attachment are selectively captured in the first and second hooks. The pin assemblies include a sleeve rotatably positioned on an attachment pin that extends between ribs of the attachment. The sleeve includes a bore that closely receives the attachment pin and the length of the sleeve is selected so that the sleeve fits closely between the attachment ribs, thereby allowing the arm assembly to pick-up various attachments with different pin diameters, ribs spacings and pin-to-pin distances. The arm assembly can be coupled to and decoupled from an associated attachment by an operator without assistance from a ground crew.

13 Claims, 19 Drawing Sheets

U.S. PATENT DOCUMENTS

| | | | | |
|---|---|---|---|---|
| 5,692,325 | A | 12/1997 | Kuzutani | 37/468 |
| 6,042,295 | A | 3/2000 | Barden | 37/468 X |
| 6,058,633 | A | 5/2000 | Barden | 37/468 |
| 6,074,120 | A | 6/2000 | Williams | 37/468 X |
| 6,158,950 | A | 12/2000 | Wilt et al. | 37/468 X |
| 6,308,442 | B1 | 10/2001 | Naka et al. | 37/468 |
| 6,438,875 | B1 | 8/2002 | Kimble et al. | 37/468 |
| 2002/0071754 | A1 | 6/2002 | Fatemi | 414/723 |

FOREIGN PATENT DOCUMENTS

| | | |
|---|---|---|
| JP | 2000-248752 | 9/2000 |
| JP | 2001-295316 | 10/2001 |
| JP | 2003-034948 | 2/2003 |

ARM ASSEMBLY FOR EXCAVATION APPARATUS AND METHOD OF USING SAME

CROSS-REFERENCE TO RELATED APPLICATIONS

This application claims benefit of the filing date of U.S. provisional application No. 60/391,062 filed Jun. 24, 2002 and U.S. provisional application No. 60/411,181 filed Sep. 16, 2002, and both of said applications are hereby expressly incorporated by reference herein.

BACKGROUND OF THE INVENTION

The present invention relates generally to construction, excavation and/or other heavy machinery such as excavators, backhoes and the like that include an arm assembly comprising an arm or "stick" and a control link, each or which is adapted for pivotable connection to an associated attachment such as a bucket or other implement for performing work, and all such machines are referred to herein as "excavation apparatus" of "excavators." The control link is operably coupled to a hydraulic cylinder or other actuator, and the position of the control link as controlled by the actuator controls the angular position of the attachment relative to the arm, i.e., extension and retraction of the control link results in curling and roll-back of the attachment, respectively.

To improve the utility and versatility of such excavation apparatus, it is most desirable that various implements be conveniently and reliably coupled to the arm. This, then, allows a single excavation apparatus to be employed with any one of a wide variety of attachments as desired. However, given the size and weight of the attachments, and the close tolerances of all connection points, changing of attachments at the end of the arm of an excavator has been found to be time-consuming, difficult and inconvenient.

In a most basic arrangement, the attachments are manually pinned to the excavator arm and any associated fluid cylinders. Such operation necessarily requires manual removal and replacement of multiple pins to achieve the desired engagement.

More recently, quick-coupler devices have been developed and have enjoyed widespread commercial success. One suitable coupling is commercially available from JRB Company, Inc., Akron, Ohio under the trademark Smart-Loc™. Such quick-couplers are pivotally pinned to the distal end of the arm and control link in the same manner as an attachment. Once a quick-coupler is operatively pinned in position, first and second recesses thereof are adapted for selective connection to first and second pins of any of a wide variety of associated attachments in a convenient and secure manner without removal of the first and second pins.

Although these quick-couplers are highly effective and convenient, they add weight to the excavator arm and also elongate the arm, the combination of which can lead to a decrease in excavator performance in certain circumstances. The additional weight of the quick coupling can decrease the lifting capacity of the excavator. The outward movement of the attachment can also reduce lifting capacity and can change the performance characteristics of the attachment.

As such, a need has been identified for an attachment quick-coupling apparatus that provides the advantages of conventional quick-coupler apparatus without many of the drawbacks associated with same.

SUMMARY OF THE INVENTION

In accordance with a first aspect of the present invention, an arm assembly for an excavator includes an arm comprising a first hook including a first open mouth. The arm further includes a first pin capturing system that selectively obstructs the first open mouth. A link is movable relative to said arm and comprises a second hook including a second open mouth. The second open mouth is oriented toward the arm, and the link further comprises a second pin capturing system that selectively obstructs the second open mouth.

In accordance with another aspect of the present invention, an arm assembly for a machine includes an arm comprising a first hook including a first open mouth. The arm further comprises a first pin capturing system that selectively captures a first associated pin in the first hook. A link is movably connected to the arm and comprises a second hook that includes a second open mouth. The second open mouth is oriented toward the arm and the link further comprises a second pin capturing system that selectively captures a second associated pin in the second hook.

In accordance with a further aspect of the invention, an apparatus comprises an arm assembly and an attachment operably connected to the arm assembly. The arm assembly comprises: (i) an arm comprising a first hook including a first open mouth and further comprising a first pin capturing member that selectively captures a first associated pin in the first hook; and, (ii) a link movably connected to the arm and comprising a second hook that includes a second open mouth, and further comprising a second pin capturing member that selectively captures a second associated pin in said second hook; The attachment comprises: first and second attachment pin assemblies. The first attachment pin assembly is non-rotatably captured in the first hook by the first pin capturing member, and the second attachment pin assembly is non-rotatably captured in the second hook by the second pin capturing member.

In accordance with another aspect of the invention, an attachment comprises a body and first and second spaced-apart ribs connected to the body. First and second spaced-apart pins extend between the first and second ribs. First and second sleeves are rotatably positioned on the first and second pins.

In accordance with a further aspect of the present invention, a sleeve for connection to an attachment pin includes a tubular portion comprising a cylindrical outer surface and defining a through-bore adapted for receipt of an attachment pin. First and second spacers are connected to opposite first and second ends of the tubular portion. The first and second spacers define respective first and second bearing surfaces that face outwardly away from each other. First and second seals are connected to said first and second spacers and overhanging the first and second bearing surfaces, respectively.

In accordance with a still further aspect of the present invention, a method of coupling an attachment to an arm assembly comprises moving a first open hook into engagement with a first pin of an attachment. The first open hook located at an end of an arm. A first pin capturing system is engaged to capture the first pin non-rotatably in the first open hook. The arm is moved to lift the attachment so that the attachment hangs freely from the arm by way of the first pin. The arm is pivoted and the link is moved relative to the arm so that a second open hook located at an end of the link moves into engagement with a second pin of the attachment. A second pin capturing system is engaged to capture the second pin non-rotatably in the second open hook.

BRIEF DESCRIPTION OF THE DRAWINGS

The invention comprises various components and arrangements of components, and comprises various steps and arrangements of steps, preferred embodiments of which are disclosed herein with reference to the accompanying drawings that form a part hereof and wherein.

DETAILED DESCRIPTION OF PREFERRED EMBODIMENTS

Figure 1A:
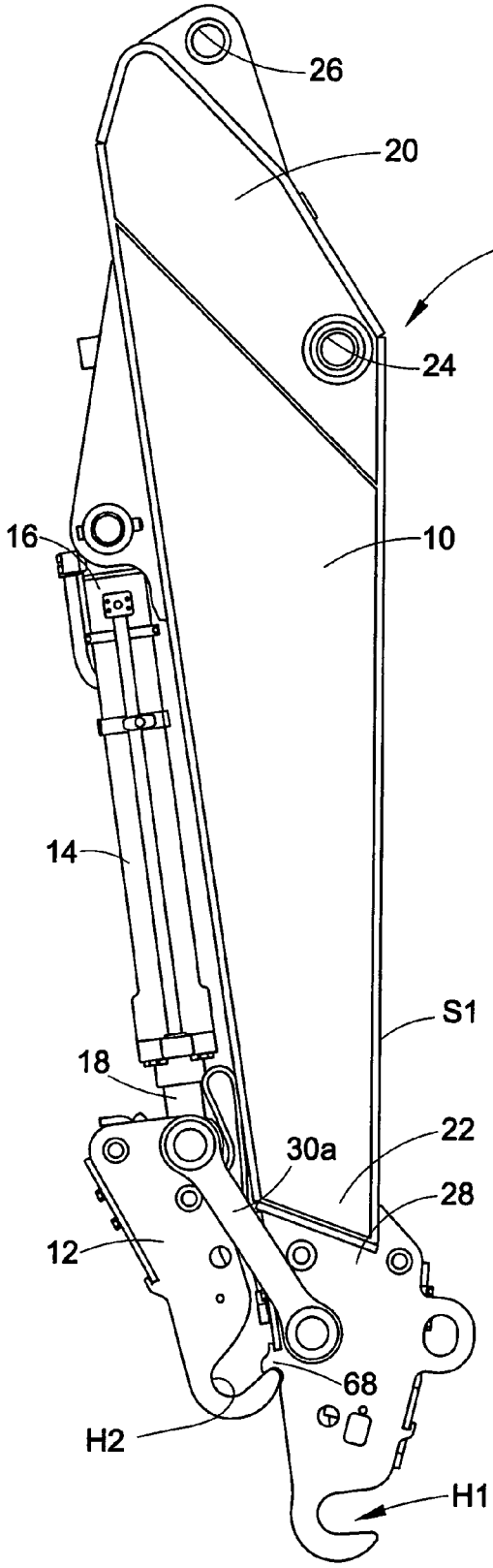
FIG. 1A is a right side elevational view of an arm assembly formed in accordance with the present invention and including an arm and a control link both formed in accordance with the present invention.

A preferred embodiment of the present invention is illustrated in the accompanying drawings. Those of ordinary skill in the art will recognize that the present invention and the components thereof, unless otherwise noted herein, are preferably constructed from suitable metals such as various high-strength steels and alloys. Also, in the drawings, some hidden components are shown in broken lines while others are shown in solid lines for clarity and ease of understanding the development.

Figure 1B:
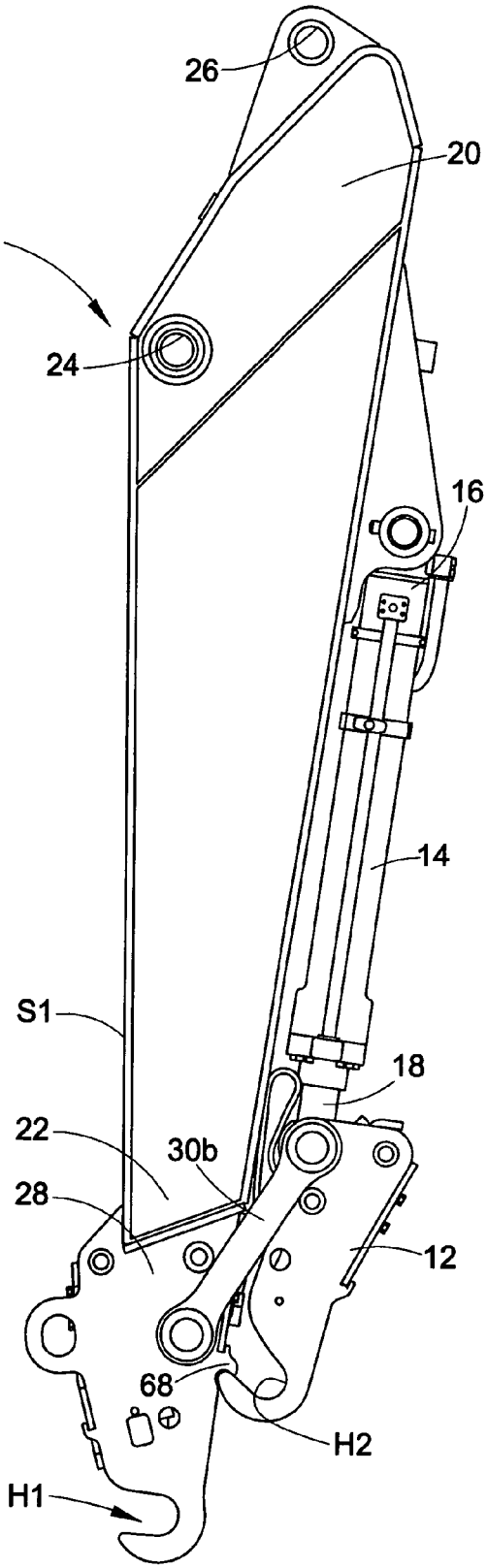
FIG. 1B is a left side elevational view of the arm assembly shown in FIG. 1A.

Referring now to FIGS. 1A and 1B, an arm assembly for an excavation apparatus such as an excavator or backhoe of the like is illustrated generally at A. The arm assembly A comprises, among other features, an arm or dipper-stick 10, a control link 12, and an attachment control cylinder 14. The arm 10 includes a first end 20 and an opposite second end 22. The first end 20 includes or defines first and second mounting bores 24,26 to be secured by a pin-on connection to a boom (not shown) and an arm control cylinder (not shown), respectively. The second end 22 of the arm 10 comprises a nose 28 formed in accordance with the present invention as described below.

The attachment control cylinder 14 includes a first end 16 pivotally secured to the arm 10 by a pin-on connection and includes a selectively-extensible rod 18 pivotally secured to the attachment control link 12 by a pin-on connection. First and second guide or "bone" links 30*a*,30*b* are located on opposite lateral sides of the arm 10 and are pivotally secured at their opposite ends to the attachment control link 12 and the arm 10. The rod 18 of the cylinder 14 is selectively extensible and retractable linearly to effect movement of the attachment control link 12 relative to the nose 28 of the arm 10 (see FIGS. 7D,7E).

Figure 1C:
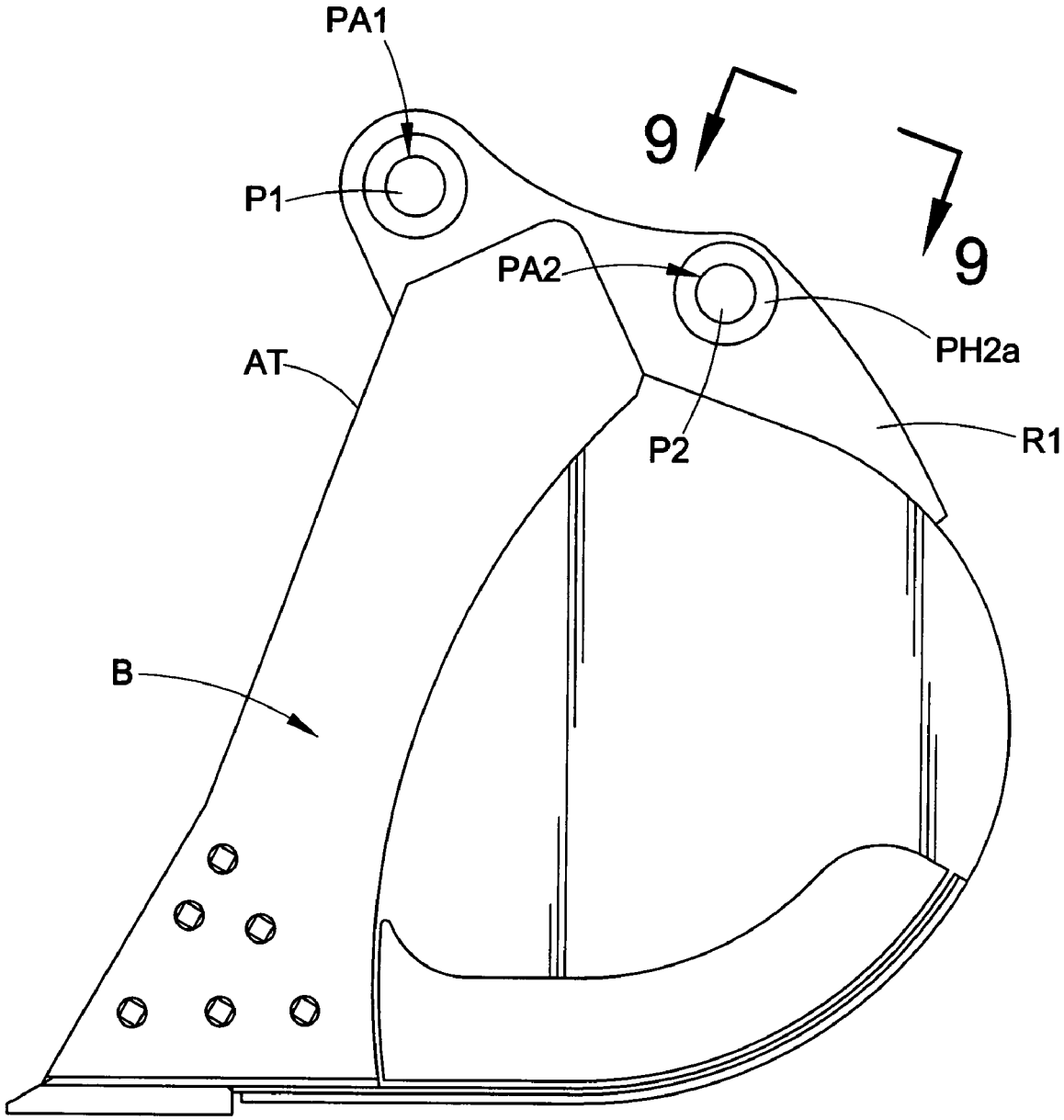
FIG. 1C illustrates an attachment to be operatively coupled to the arm assembly of FIGS. 1A and 1B to perform work, wherein the attachment includes pin sleeves in accordance with the present invention.
Figure 9:
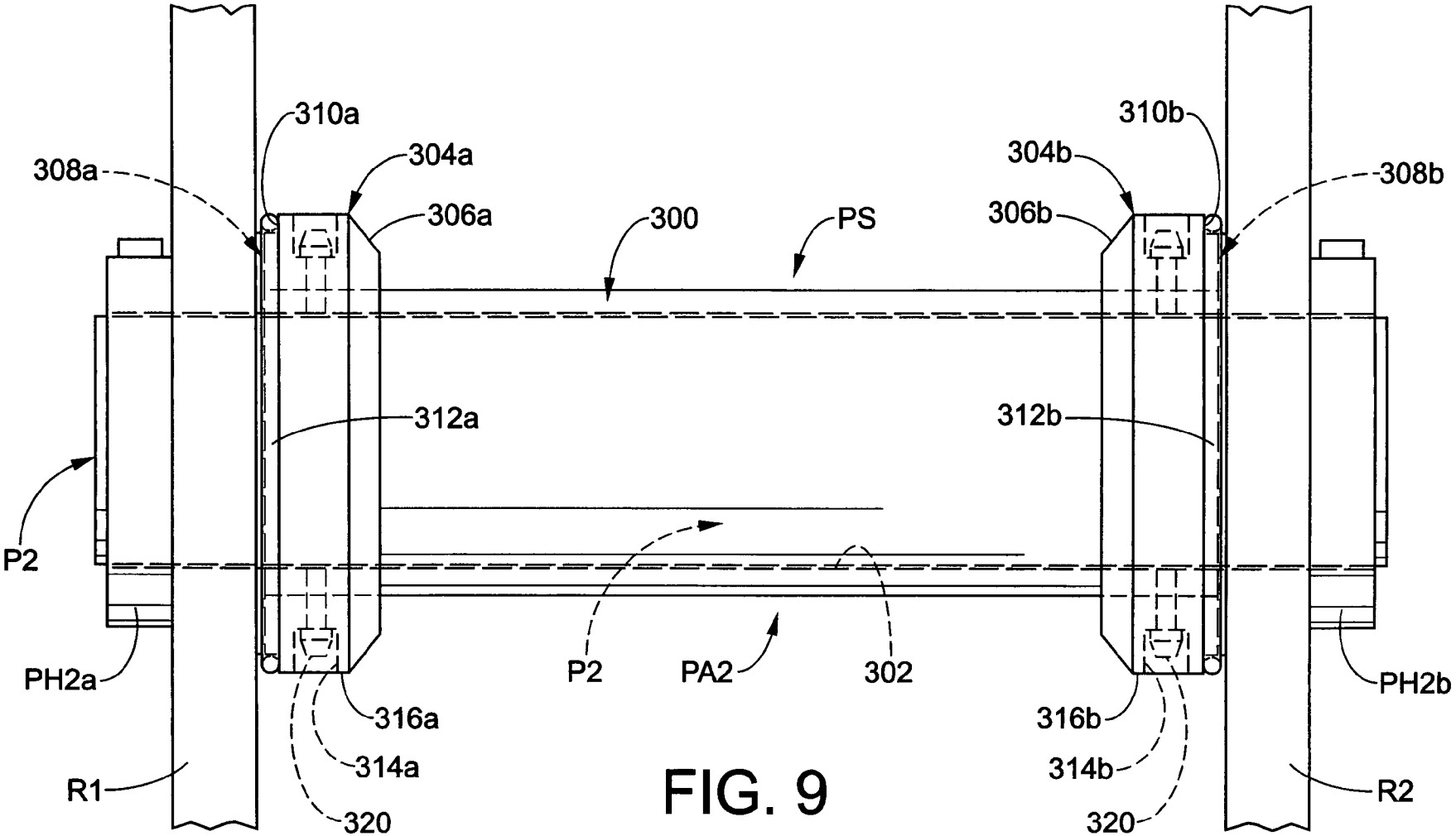
FIG. 9 is a view taken along line 9—9 of FIG. 1C and showing the pin sleeve of FIG. 8 in an operative state.

FIG. 1C illustrates an associated attachment AT to be operatively secured to the arm assembly A. The attachment AT (shown herein as a bucket for moving earth or the like) comprises a body B for performing work and first and second parallel (meaning exactly or substantially parallel) spaced-apart pin assemblies PA1,PA2 that extend between first and second ribs R1,R2 (see also FIG. 9) that are connected to the body B. FIG. 9 shows the pin assembly PA2 is detail and the pin assembly PA1 is correspondingly constructed as will be apparent to those of ordinary skill in the art upon reading this specification. As shown in FIG. 9, the pin assembly PA2 comprises a conventional attachment pin P2 and a sleeve PS that coaxially surrounds same. Although not shown in FIG. 9, the pin assembly PA1 comprises a conventional attachment pin P1 and a sleeve PS that coaxially surrounds same. The pin assemblies PA1,PA2 are described in further detail below. As used herein, the term "pin" is intended to refer to a conventional pin and/or a pin assembly PA1,PA2 as described herein.

Figure 2A:
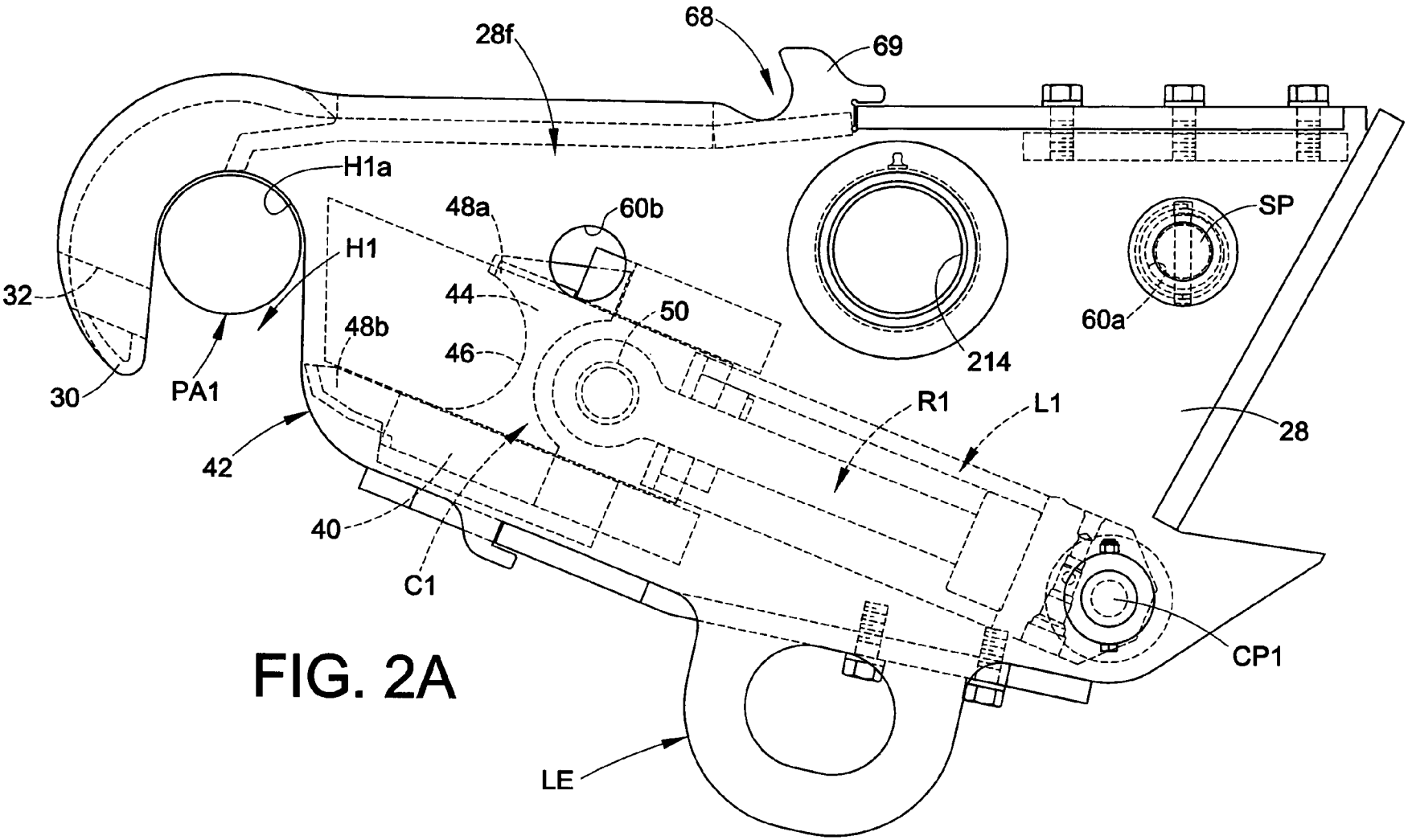
FIGS. 2A and 2B are side elevational views that illustrate the nose portion of an arm formed in accordance with the present invention, in an unlocked and locked condition, respectively.
Figure 2B:
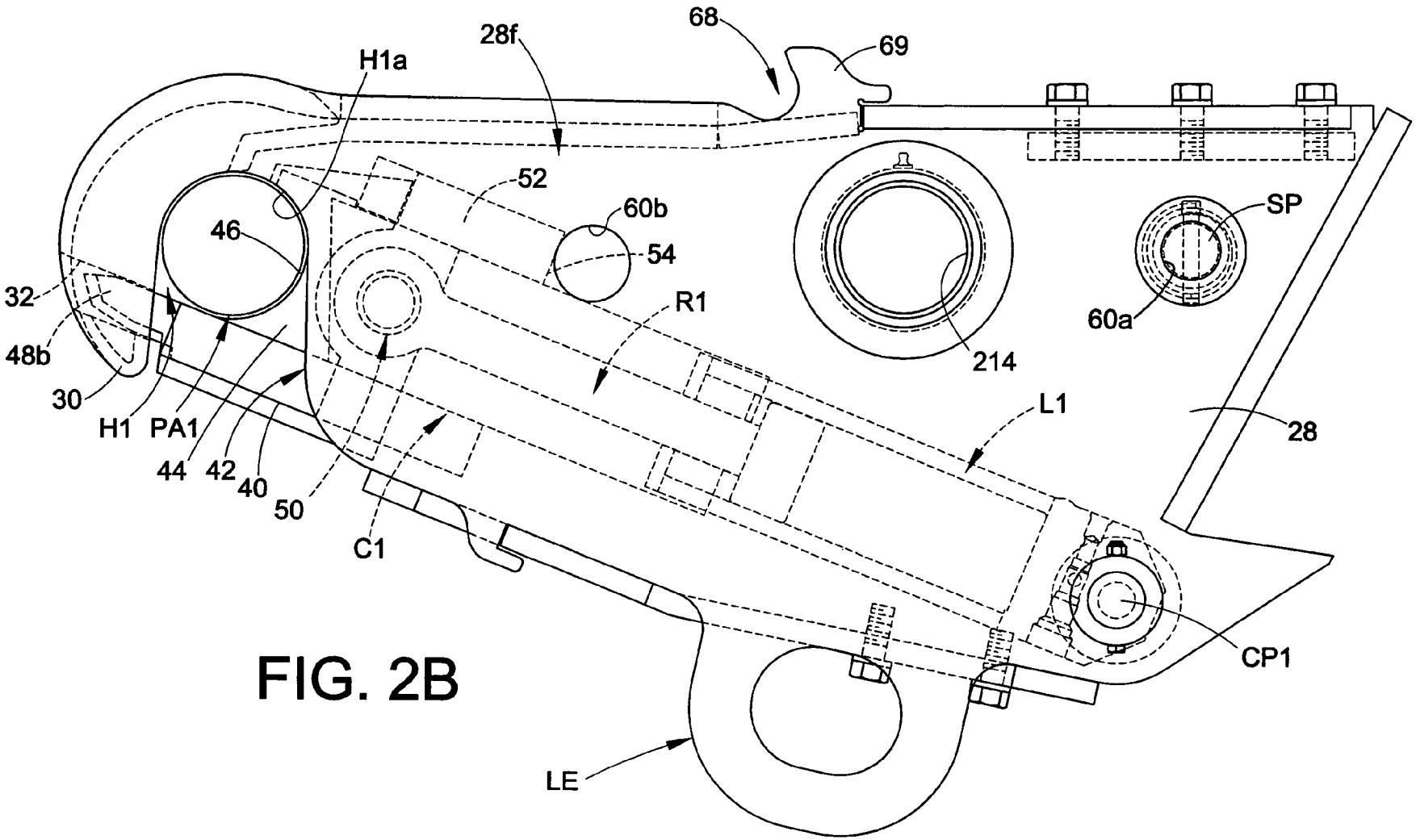

With reference also to FIGS. 2A and 2B, the nose 28 of arm 10 defines or otherwise includes a first open pin-receiving hook or recess H1 adapted to receive the attachment pin assembly PA1 with a close fit. The hook H1 includes a mouth 42 that opens in a first direction through an inner side S1 of the arm 10 that is oriented inward toward the excavation machine and/or downward toward the ground when the arm assembly A is in use.

Figure 4A:
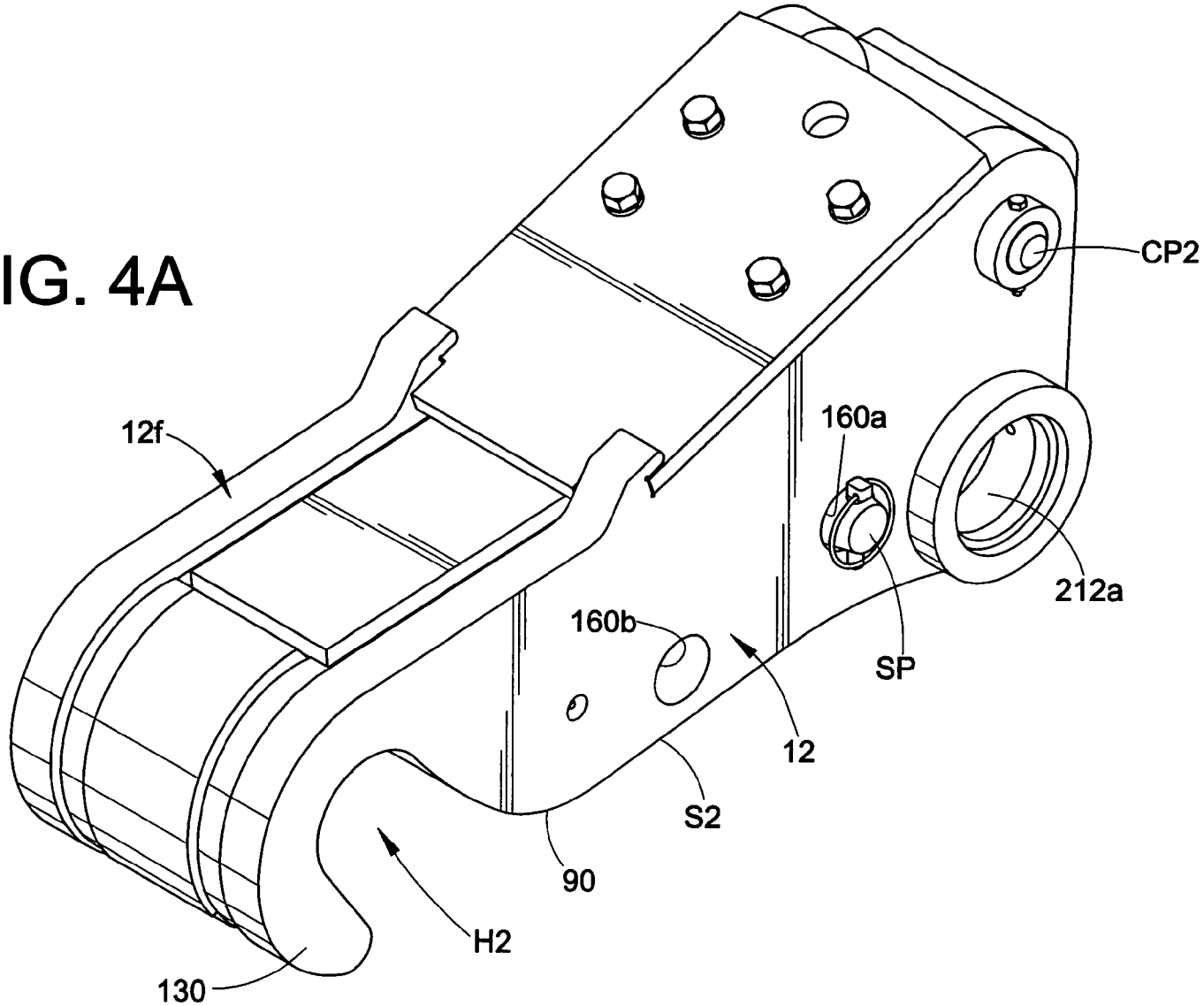
FIG. 4A is an isometric view of the control link portion of the arm assembly shown in FIGS. 1A and 1B.
Figure 4B:
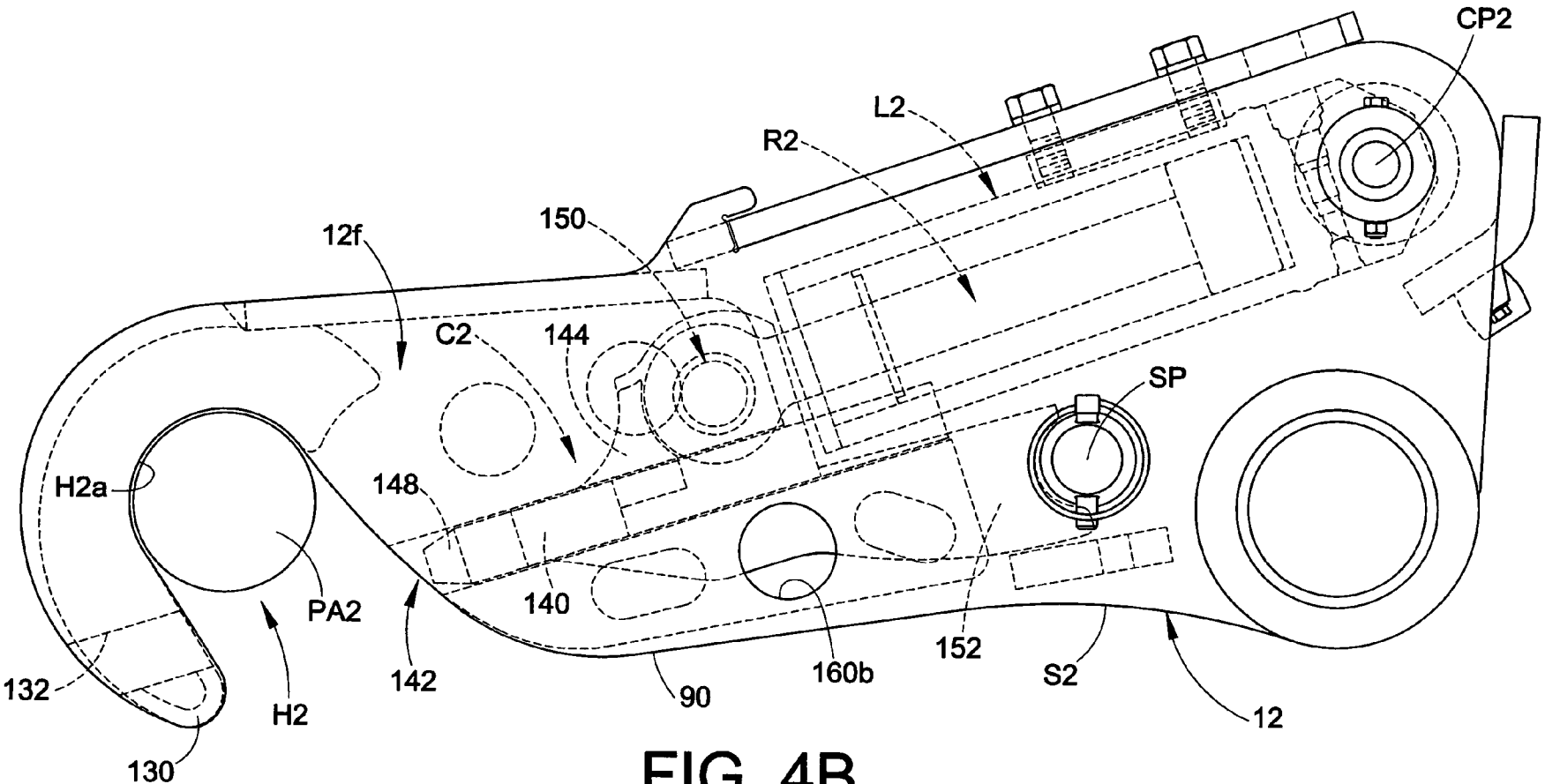
FIGS. 4B and 4C are side elevational views of the control link shown in FIG. 4A in an unlocked and locked state, respectively.
Figure 4C:
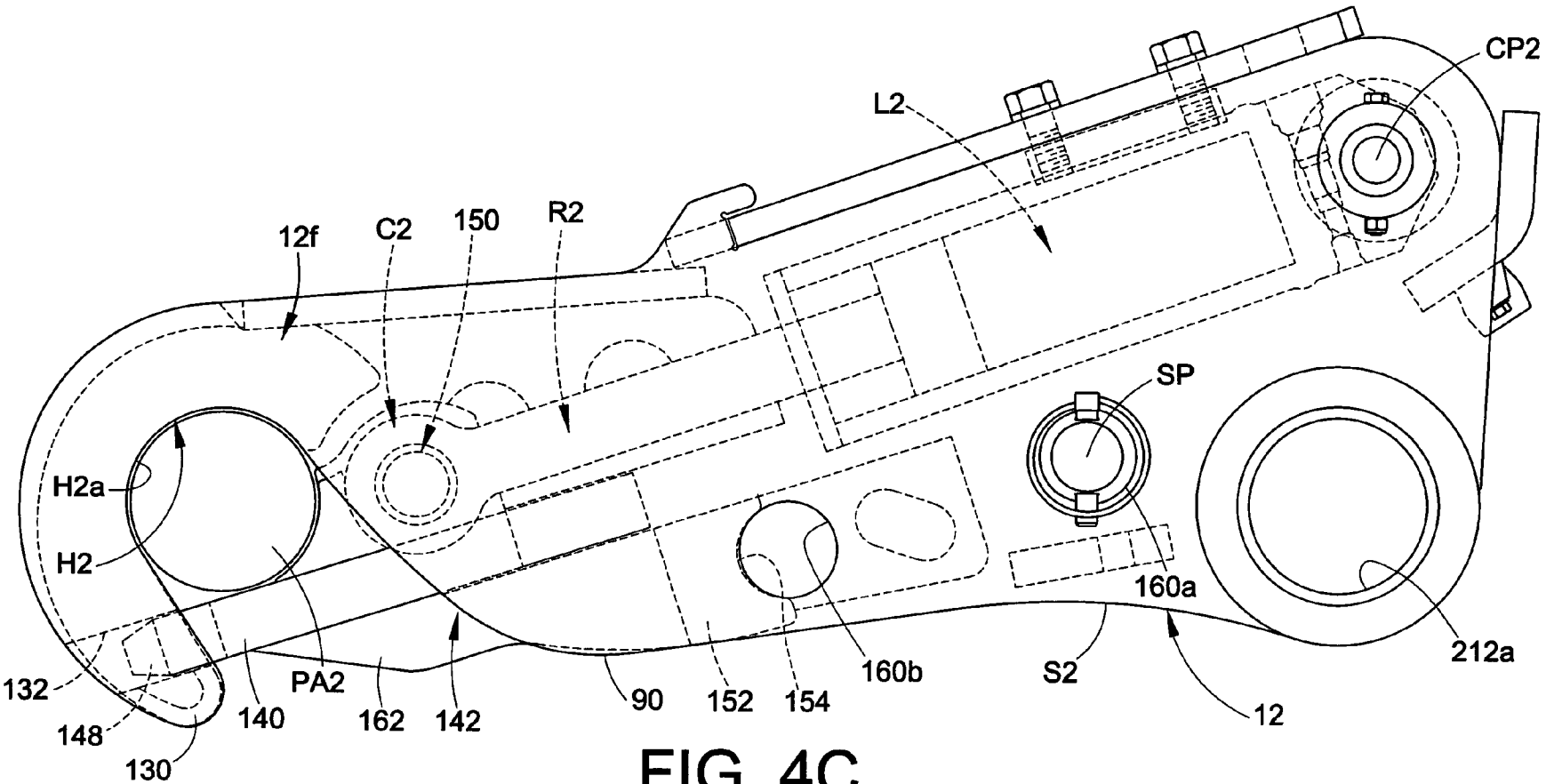

Referring also to FIGS. 4A–4C, the control link 12 defines or otherwise includes a second open pin-receiving hook or recess H2 adapted to receive the attachment pin assembly PA2 with a close fit. The hook H2 includes a mouth 142 that opens through an inner side S2 of the link 12 that is oriented toward the arm 10.

The nose 28 of the arm 10 comprises a first pin-capturing system C1 (FIGS. 2A, 2B) for selective capturing the first pin assembly PA1 in the first hook H1. The attachment control link 12 comprises a second pin-capturing system C2 (FIGS. 4A–4C) for selective capturing the second pin assembly PA2 in the second hook H2. When the pin assemblies PA1,PA2 are captured in the respective hooks H1,H2, the bucket or other associated attachment AT is said to be operatively connected or coupled to the arm assembly A, and, in this operative state, the rod 18 of the attachment control cylinder 14 is selectively extended and retracted to pivot the attachment AT relative to the arm 10 between a first operative position (often referred to as a "dump" or "roll-back" position) as shown in FIG. 7D, and a second operative position (often referred to as a "full-curl" position) as shown in FIG. 7E.

With specific reference now to FIGS. 2A and 2B, the first pin capturing system C1 of the nose 28 comprises a first pin capture member 40 that is movably connected to a frame 28*f* of the nose 28 and adapted for movement between a first or "unlock" position (FIG. 2A) and a second or "lock" position (FIG. 2B). In the first position, the pin capture member 40 is retracted relative to the hook H1 and, more particularly, relative to the open mouth 42 of the hook H1 so that the mouth 42 is unobstructed by the pin capture member 40. The term "unobstructed" is intended to define a condition where the pin capture member 40 is positioned so that it does not prevent movement of the first associated attachment pin assembly PA1 into and out of the first hook H1 via mouth 42. Thus, when the pin capture member 40 is in its first position, the associated attachment pin assembly PA1 is freely insertable in and removable from the hook H1 via mouth 42. Depending upon the dimensions and conformation of the hook H1 and mouth 42, the first pin capture member 40 can be completely retracted from the mouth 42 as is preferred or it can partially extend into the mouth 42 even when it is located in the first operative "retracted" position.

FIG. 2B shows the pin capture member 40 moved to its second operative or "extended" position as where it captures the pin assembly PA1 in the hook H1. In the extended position, the pin capture member at least partially blocks the open mouth 42 of the hook H1 to prevent the pin assembly PA1 from exiting the hook H1 through the mouth 42. In a most preferred embodiment, as illustrated, the first pin capture member 40 completely blocks the open mouth 42 of the hook H1 when moved to its second operative position and also closely engages the pin assembly PA1 to thereby capture the pin assembly PA1 in the hook H1. The pin capture member 40 preferably includes a C-shaped pin retainer 44 defining a partially-cylindrical recess 46 that closely receives and partially surrounds the pin assembly PA1 when the pin capturing member 40 is fully extended in its second operative position. The recess 46 and a partially cylindrical inner surface H1*a* of the hook H1 cooperate to encircle at least a majority (i.e., encircle more than 180 and most preferably at least 270 degrees of) the pin assembly PA1 when the pin capturing member 40 is extended. Furthermore, the tip 30 of the nose 28 defines a slot 32 that opens into the hook H1 and also outwardly through the tip 30 so that the slot 32 is open at its opposite ends. The C-shaped pin retainer portion 44 of the pin capture member 40 includes first and second tips 48*a*,48*b*, and the tip 48*b* is preferably received in the open slot 32 when the pin capture member 40 is extended as shown in FIG. 2B. The open slot 32 is self-cleaning in that the tip 48*b* urges dirt and debris out of the open slot 32 as it moves into the slot 32. When the pin capture member 40 is extended, engagement of the tip 48*b* in the slot 32 adds strength to the pin capturing system C1 in that forces exerted by the pin assembly PA1 on the pin capture member 40 will be partially transmitted to the tip 30 of the nose 28.

Figure 3A:
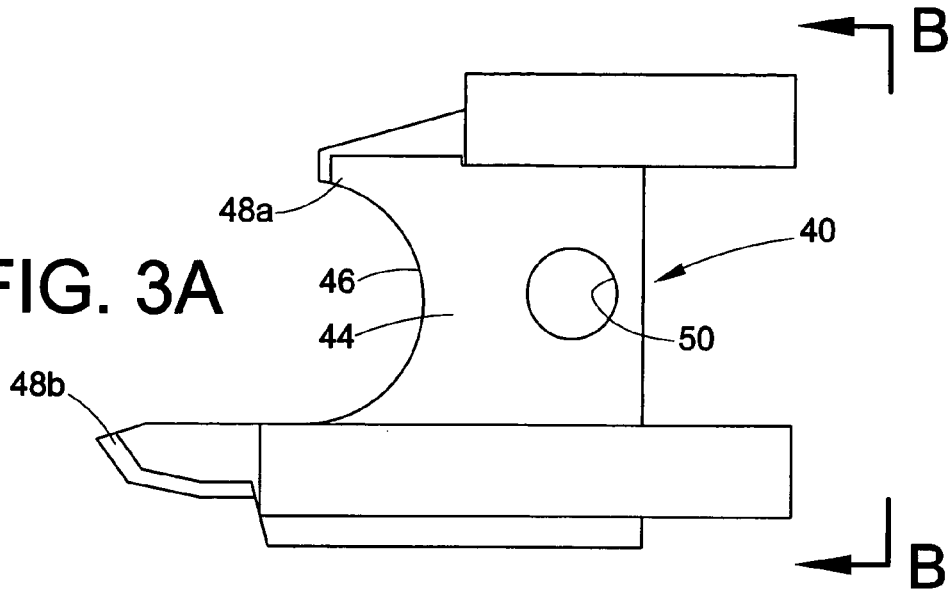
FIG. 3A is a side elevational view of a pin capture member that forms a part of the nose portion shown in FIGS. 2A and 2B.
Figure 3B:
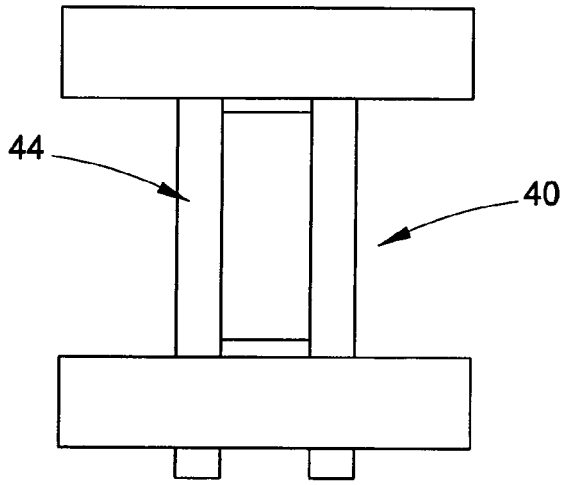
FIG. 3B is a view taken along line B—B of FIG. 3A.

The first pin capture member 40 is shown by itself in FIGS. 3A and 3B. It is noted that the tip 48*b* is beveled or chamfered so that, when the member 40 is extended, the tip 48*b* acts as a wedge to urge the pin assembly PA1 further into the hook H1 if the pin is not already fully seated in the hook. As noted, when the member 40 is fully extended, the pin retainer 44 (in particular the portion thereof defining the recess 46) also engages the pin assembly PA1 and urges same fully into the hook H1 so that the pin assembly PA1 contacts the hook inner surface H1*a*.

It is most preferred that the pin capturing member 40 be slidably movable to and between its first and second operative positions by means of an actuator such as hydraulic or other fluid cylinder L1 or another suitable actuator such as a hydraulic screw actuator or the like that is operably connected between an anchor point and the pin capturing member 40. In the illustrated embodiment, a cross-pin CP1 extends laterally between and is secured in aligned apertures in nose 28 and the cylinder L1 is connected thereto. Manual movement of the pin capture member 40 is also contemplated (by disconnecting it from the cylinder L1) and deemed to be within the scope of the present invention. In the illustrated embodiment, the hydraulic cylinder L1 includes a rod R1 that connects to a aperture, yoke or other mounting location 50 on the member 40. The rod R1 extends and retracts linearly (compare FIGS. 2A and 2B) to move the first pin capture member 40 connected thereto correspondingly.

Figure 3C:
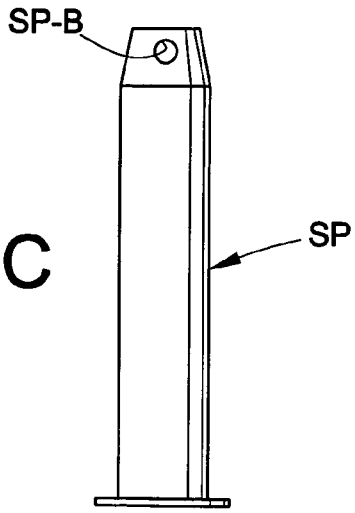
FIG. 3C illustrates a mechanical lock pin formed in accordance with the present invention.

The first pin capture member 40 further comprises a stop portion 52 including or defining a stop surface 54. The arm assembly A preferably comprises a stop-pin SP (see also FIG. 3C), and first and second stop-pin-receiving locations 60*a*,60*b* are defined by the nose 28. The first location 60*a*, where the pin is shown in FIGS. 2A and 2B, is merely an inoperative pin-storage position. When the pin capture member 40 is moved fully to its second operative (fully extended) position as shown in FIG. 2B, the stop surface 54 is located adjacent the location 60*b* so that when the stop-pin SP is inserted into the second pin-receiving location 60*b*, the stop-pin SP engages the stop surface 54 and prevents movement of the pin capture member 40 from the second operative position back to the first operative position, even under force of the actuator L1. In the event the cylinder L1 is rendered inoperable, the pin capture member 40 can be moved manually to the extended position and the stop pin SP can be used as described to hold the pin capture member 40 in its extended position during use of the arm assembly A. The stop-pin SP (FIG. 3B) includes a cross-bore SP-B that receives a ring, pin or other member that prevents unintended movement of the stop-pin out of either pin-receiving location 60*a*,60*b*. The stop-pin SP is tapered at its insertion end to facilitate its insertion.

The nose 28 of arm 10 preferably includes or defines a lift eye LE integrated into its frame 28*f*. This lift eye LE provides an attachment point for a chain or the like as used for lifting articles or other uses.

As noted, an arm assembly A formed in accordance with the present invention comprises both the arm 10 (including nose 28) and the control link 12. With specific reference now to FIGS. 4B and 4C, the second pin capturing system C2 of the control link 12 comprises a second pin capture member 140 that is movably connected to a frame 12*f* of the link 12 and adapted for movement between a first operative "unlock" position (FIGS. 4A,4B) and a second operative "lock" position (FIG. 4C). In the first operative position, the pin capture member 140 is retracted relative to the hook H2 and, more particularly, the open mouth 142 of the hook H2 so that the mouth 142 is unobstructed by the pin capture member 140. The term "unobstructed" is intended to define a condition where the pin capture member 140 is positioned so that it does not prevent movement of the second associated attachment pin assembly PA2 into and out of the second hook H2 via mouth 142. Thus, when the pin capture member 140 is in its first operative or "unlock" position, the pin assembly PA2 is freely insertable in and removable from the second hook H2 via second mouth 142.

FIG. 4C shows the second pin capture member 140 in its second operative "lock" position as where it captures the second pin assembly PA2 in the second hook H2. In this second operative position, the pin capture member 140 at least partially blocks the open mouth 142 of the hook H2 to prevent the pin assembly PA2 from exiting the hook H2 through the mouth 142.

Figure 6A:
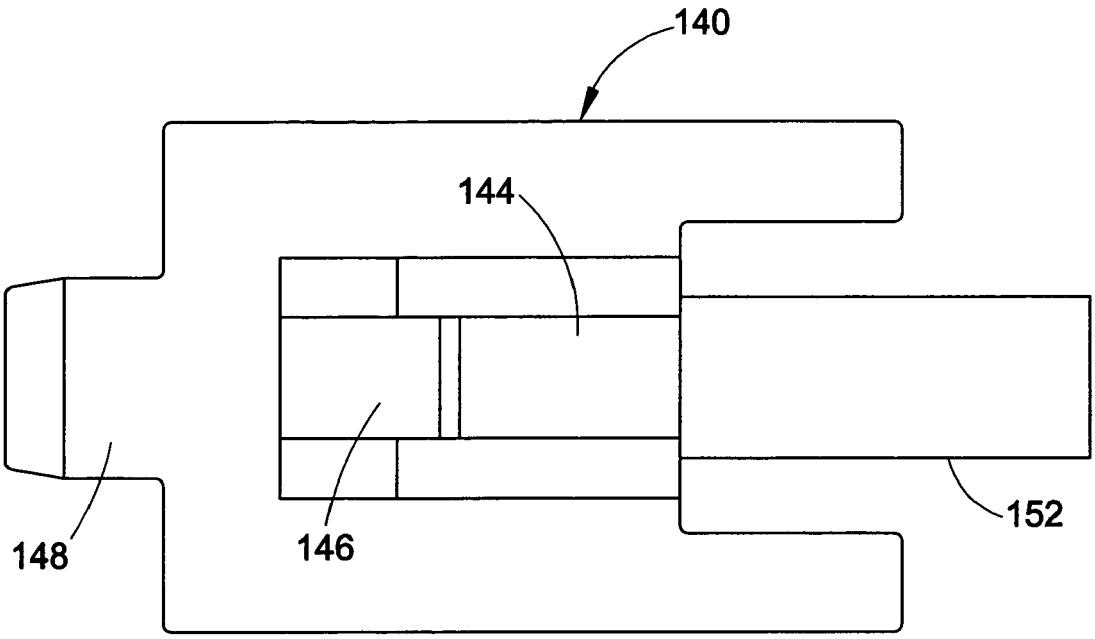
FIGS. 6A and 6B are top plan and side elevational views of a pin capture member that forms a part of the control link shown in FIGS. 4A–4C.
Figure 6B:
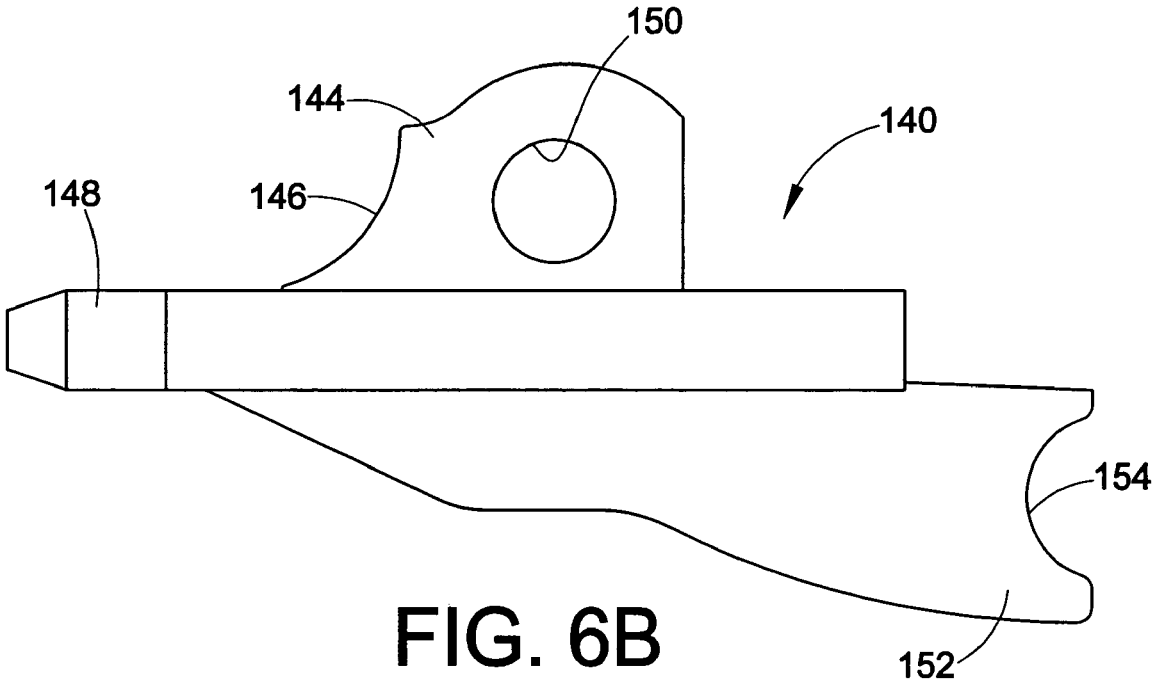

In a most preferred embodiment as illustrated, the pin capture member 140 completely blocks the open mouth 142 of the hook H2 when it is moved to its second operative position and also closely engages the pin assembly PA2 to thereby capture same in the hook H2. As shown, the pin capture member 140 (shown separately in FIGS. 6A,6B) preferably includes a pin retainer 144 defining a curved, preferably partially-cylindrical recess 146 that closely engages the pin assembly PA2 when the pin capturing member 140 is fully extended. The recess 146 and a partially cylindrical inner surface H2*a* of the hook H2 cooperate to encircle at least a majority of (i.e., encircle more than 180 degrees and most preferably at least 250 degrees of) the pin assembly PA2 when the pin capturing member 140 is extended. Furthermore, as also shown, a tip 130 of the link 12 defines a slot 132 that opens into the hook H2 and also outwardly through the tip 130 so that the slot 132 is open at its opposite ends. The pin retainer portion 144 of the pin capture member 140 includes a tongue 148, and a tip portion of the tongue is received in the open slot 132 when the pin capture member 140 is extended as shown in FIG. 4C. The open slot 132 is self-cleaning in that the tongue 148 moves dirt and debris out of the open slot 132 as it moves into the slot 132. When the pin capture member 140 is extended, engagement of the tongue 148 in the slot 132 adds strength to the pin capturing system C1 in that forces exerted by the pin assembly PA2 on the pin capture member 140 will be partially transmitted to the tip 130 of the link 12. It is noted that the tongue 148 is beveled or chamfered so that, when the member 140 is extended, the tongue 148 acts as a wedge to urge the pin assembly PA2 further into the hook H2 if the pin assembly is not already fully seated in the hook. As noted, when the member 140 is fully extended, the pin retainer 144 (in particular the portion thereof defining the recess 146) also engages the pin assembly PA2 and acts as a ramp to urge the pin assembly fully into the hook H2 so that the pin assembly makes hard contact with the inner surface H2*a*.

It is most preferred that the pin capturing member 140 be slidably movable to and between its retracted and extended position by means of a hydraulic or other fluid cylinder L2 or other actuator such as a hydraulic screw actuator operably connected between the link frame 12*f* and the pin capturing member/retainer 140. Manual movement of the pin capture member 140 is also contemplated and deemed to be within the scope of the present invention. As shown, the cylinder L2 includes a rod R2 that connects to a aperture, yoke or other location 150 on the member 140. The rod R2 extends and retracts linearly (compare FIGS. 4A and 4C).

The pin capture member 140 further comprises a stop portion 152 including or defining a stop surface 154. Like the arm 10, the link 12 preferably also comprises a stop-pin SP as shown separately in FIG. 3B, and first and second stop-pin-receiving locations 160*a*,160*b* are defined by the link frame 12*f*. The first location 160*a*, where the pin is located in FIGS. 4A–4C, is merely an inoperative pin storage position. However, when the pin capture member 140 is moved fully to its second operative position as shown in FIG. 4C, the stop surface 154 thereof is located adjacent the pin-receiving location 160*b* so that when the stop-pin SP is inserted into the location 160*b*, the stop-pin SP engages the stop surface 154 and prevents movement of the pin capture member 140 from its second operative position to its first operative position. In the event the cylinder L2 is rendered inoperable, the pin capture member 140 can be moved manually to its extended position and the stop pin SP can be used in the described manner to hold the pin capture member 140 in its extended position during use of the arm assembly A. As noted above, the stop-pin SP (FIG. 3B) includes a cross-bore SP-B that receives a ring, pin or other member that prevents unintended movement of the stop-pin out of either location 160*a*,160*b*. The stop portion 152 and stop surface 154 of pin capture member 140 are preferably defined as part of a support rib 162 that extends substantially the length of the pin capture member 140 to add strength thereto.

Figure 5A:
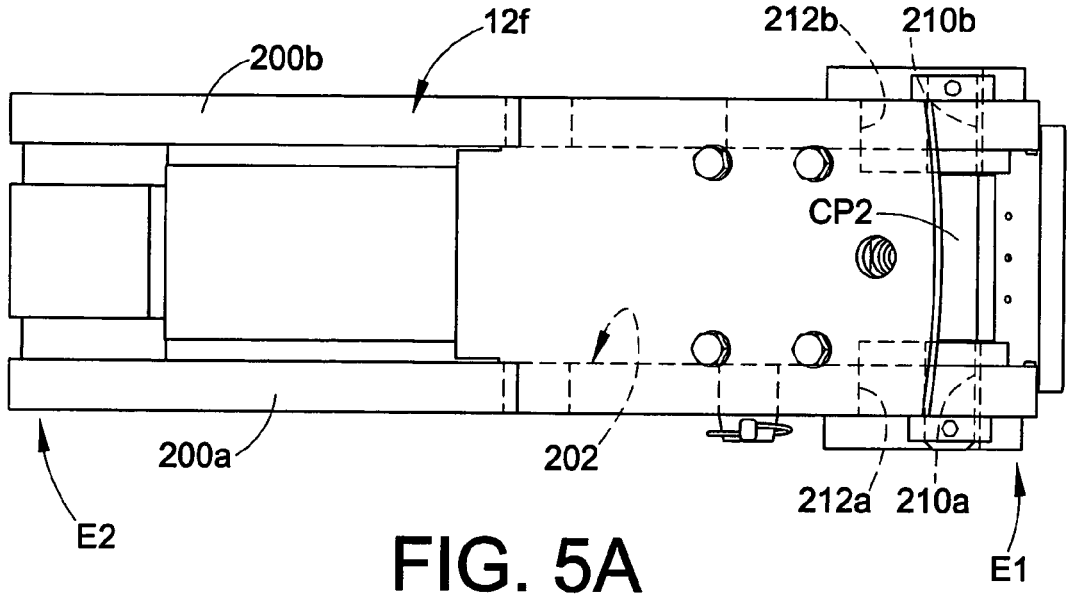
FIGS. 5A and 5B are top plan and side elevational views of a frame portion of the control link shown in FIGS. 4A–4C.
Figure 5B:
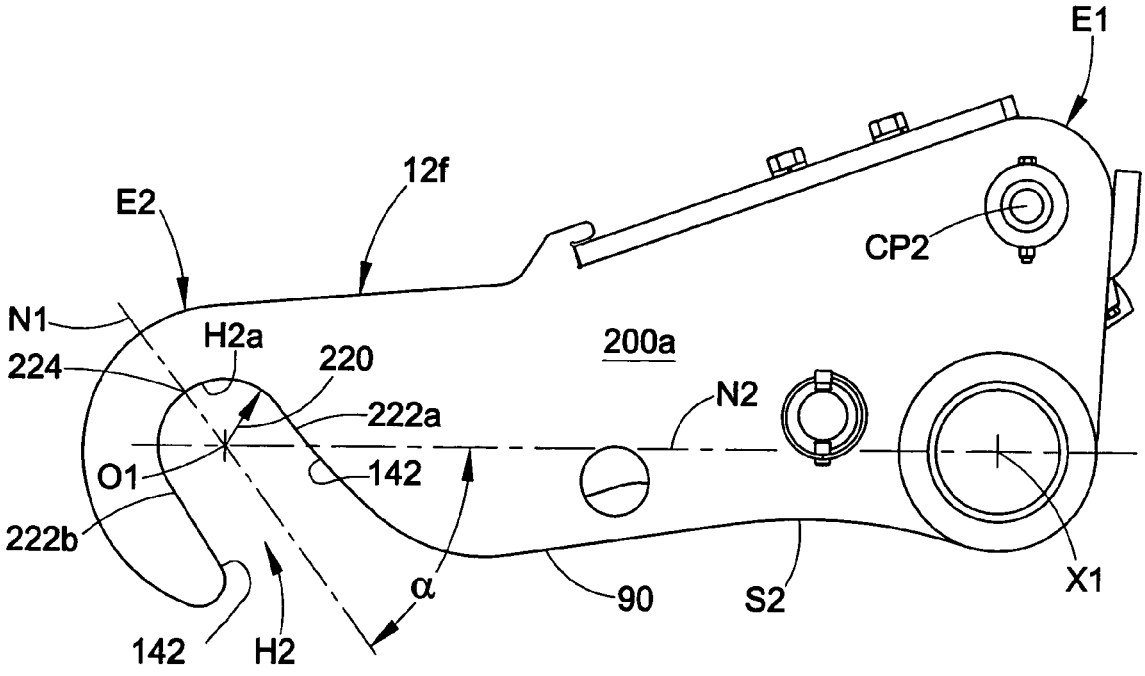

Referring now particularly to FIGS. 5A and 5B, the link frame 12*f* comprises first and second interconnected but spaced-apart parallel or substantially parallel ribs 200*a*,200*b* defining therebetween a space 202 in which the pin capturing system C2 is held. The frame 12*f* includes a first axial end E1 and a second axial end E2. The ribs 200*a*,200*b* define a first pair of aligned bores 210*a*,210*b* that receive a cross-pin CP2 (see also FIGS. 4A–4C) to which the cylinder L2 is connected. The ribs 200*a*,200*b* further define a second pair of aligned bores 212*a*,212*b* that serve as a pin-on connection point for the guide links 30 and also the rod 18 of the attachment control cylinder 14. The bores 212*a*,212*b* define a central axis X1 (FIG. 5B) about which the guide links 30 and rod 18 pivot (the opposite ends of the guide links are secured to the nose 28 of the arm 10 by a pin-on connection to a bore (or a pair of aligned bores) 214 numbered in FIGS. 2A,2B). The hook H2 includes an inner partially-cylindrical surface H2*a* defined by a radius 220 (FIG. 5B) centered at an origin O1. The surface H2*a* preferably describes a maximum of 180 degrees between first and second ends 222*a*,222*b*. The radius 220 is equal to or minimally larger than a radius of the outer cylindrical surface of the pin assembly PA2. The surface H2*a* defines a point 224 that lies halfway between the ends 222*a*,222*b*.

A first plane N1 can thus be defined as passing through the point 224 and the origin O1. A second plane N2 can be defined as passing through the origin O1 and the axis X1. In the illustrated embodiment, a hook angle a is defined between these two planes N1,N2 and is less than 90 degrees. The hook H2 is preferably conformed so that its mouth 142 opens in a direction oriented toward the first end E1 of the frame 12*f* so that an associated pin P2 moving into the hook H2 from the mouth 142 toward the inner surface H2*a* upon movement of the link 12 relative to the pin assembly PA2 must move with an axial component of movement away from the first end E1 and toward the second end E2 of the frame 12*f*. This arrangement facilitates engagement of the hooks H1,H2 with the pin assemblies PA1,PA2 by simply manipulating the arm 10 and link 12 (as described below) without manual operations to eliminate the need for an operator to exit his/her cab during this procedure.

With brief reference again to FIGS. 2A and 2B, the nose 28 of arm 10 includes or defines a temporary hook engagement region 68 with which the hook H2 of link (specifically the tip 130 thereof) is selectively engageable as shown in FIGS. 1A and 1B. The region 68 is preferably defined by one or more upstanding hooks or tabs 69. When the hook H2 of link 12 is engaged with the temporary hook engagement region 68, the link 12 is unable to swing uncontrollably as could otherwise occur during coupling/decoupling operations. The hook H2 of link 12 is preferably engaged with the temporary hook engagement region 68 for transport and storage of the arm assembly A to prevent swinging movement of the link 12.

The attachment control link 12 comprises an unobstructed pin guide surface or ramp 90 (see FIG. 5B) that curves or slopes from the inner surface S2 of the link 12 into the mouth 142 of the hook H2. This pin guide surface 90 is unobstructed in the sense that no other portion of the link 12 projects outwardly from this surface in a manner that would block or inhibit sliding or other movement of the pin assembly PA2 on or adjacent the ramp 90 as the pin assembly PA2 is received by the mouth 142 of hook H2.

Figure 7A:
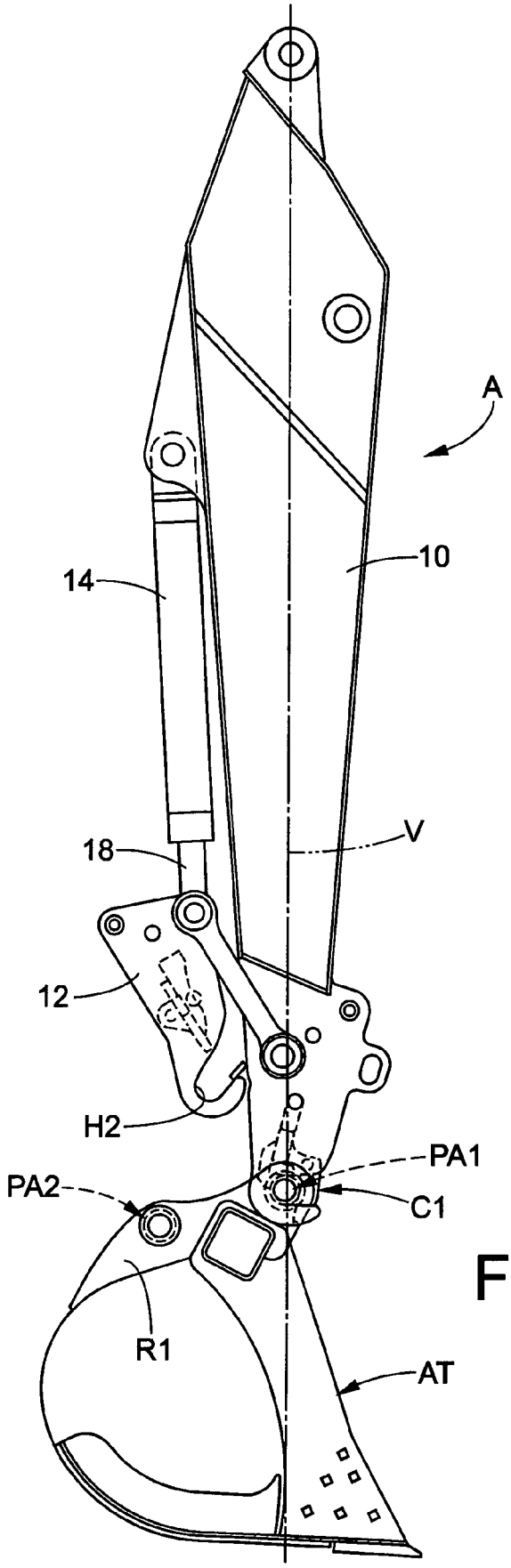
FIGS. 7A–7C diagrammatically illustrate an attachment coupling/decoupling method in accordance with the present invention.
Figure 7B:
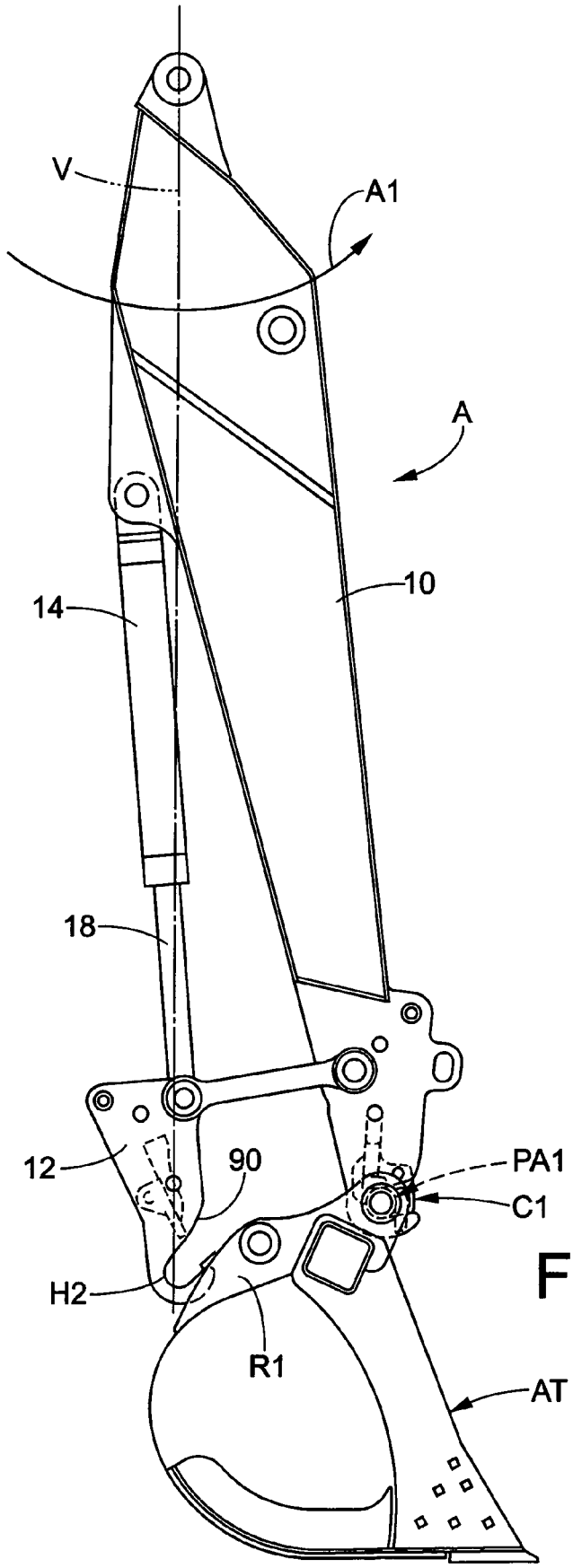
Figure 7C:
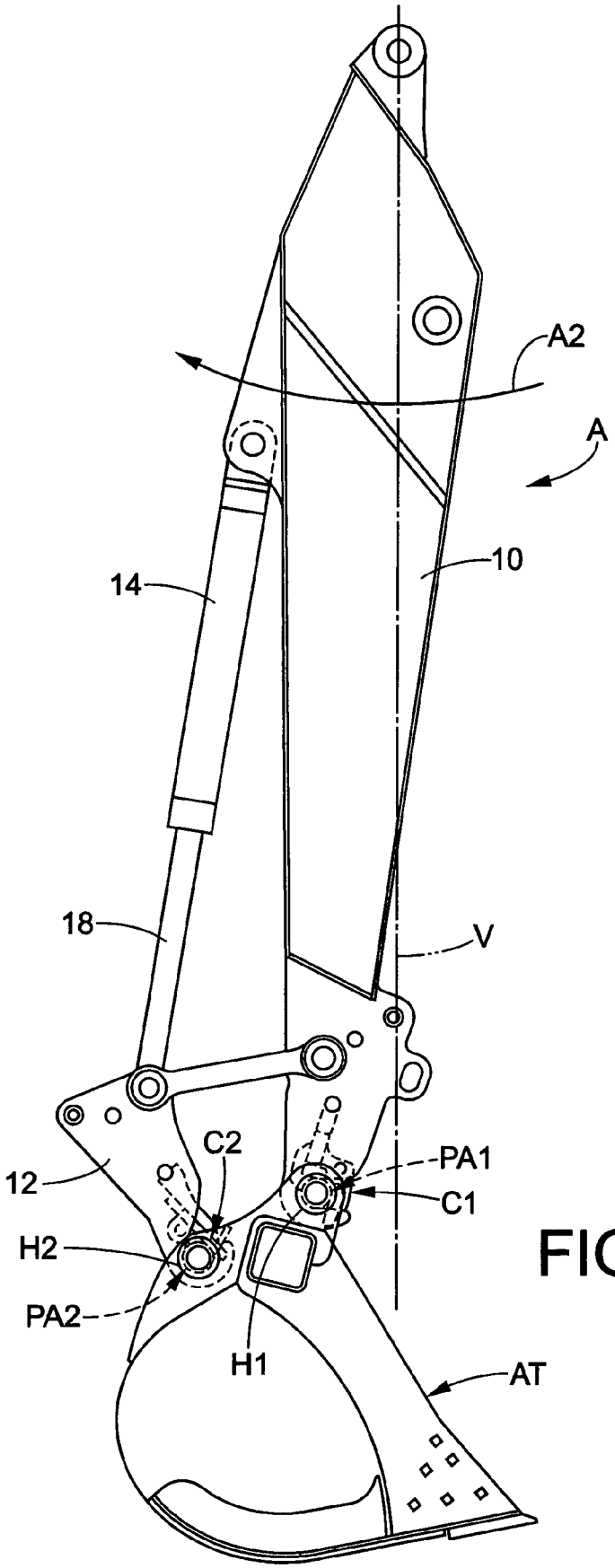
Figure 7D:
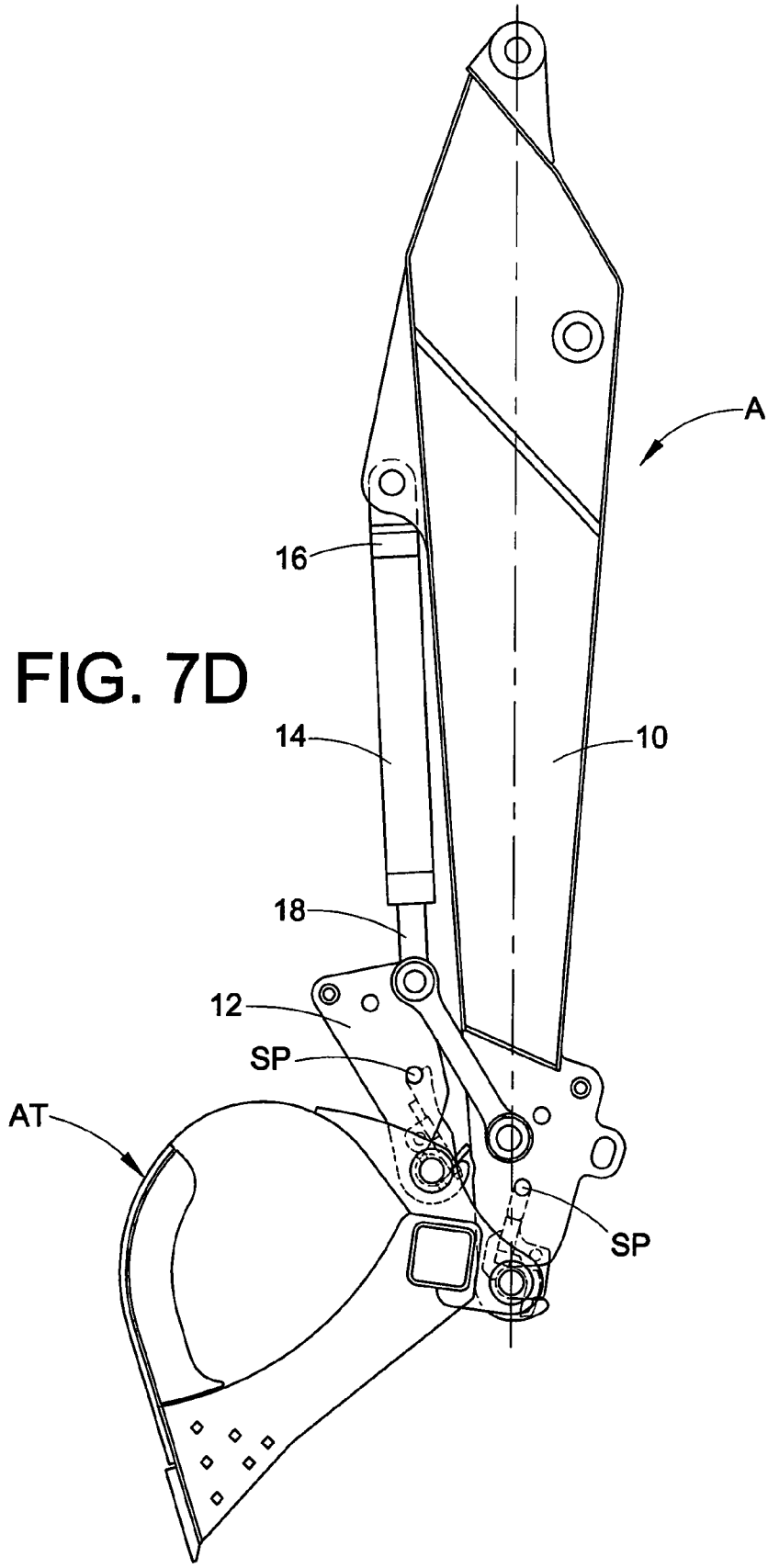
FIGS. 7D and 7E illustrate an arm assembly formed in accordance with the present invention and an associated attachment operably coupled thereto in first and second operative positions, respectively.
Figure 7E:
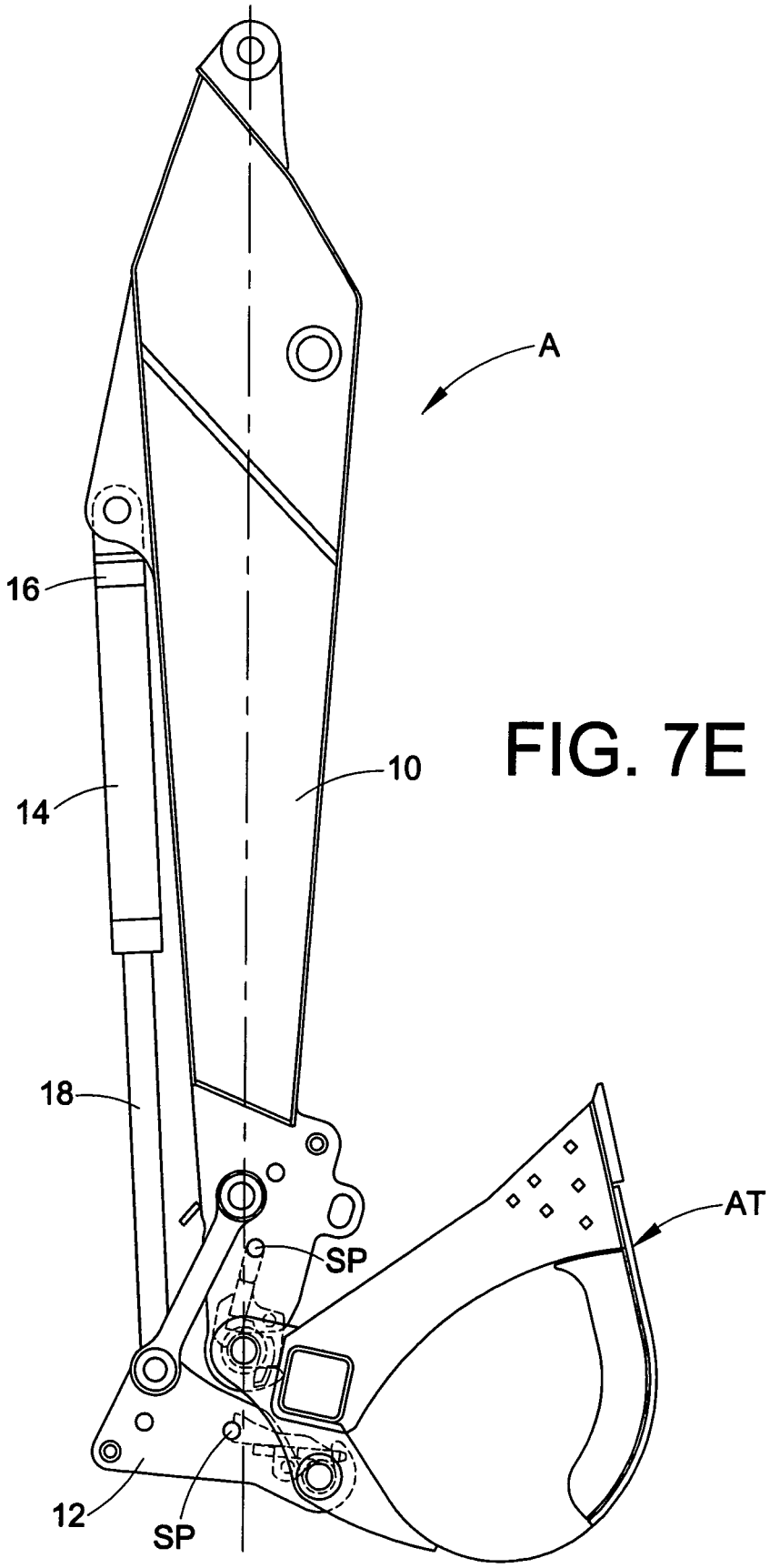

Operation of the arm assembly A to couple an associated attachment B thereto is now disclosed (the decoupling procedure is the reverse of the coupling procedure) with reference to FIGS. 7A–7C (the arm assembly A is shown only diagrammatically in FIGS. 7A–7C for ease in understanding the coupling/decoupling sequence). To pick-up an attachment AT, the link 12 is retracted, preferably fully so that the hook H2 engages and is retained in the hook engagement region 68 of arm 10 (unless the hook H2 is already engaged with the hook engagement region 68). With the first pin retainer 40 in its first operative (unlocked) state, the arm 10 is moved so that the first pin assembly PA1 of the attachment AT is fully received into the hook H1 (it may be necessary for the operator to drag the attachment AT on the ground slightly to move the pin assembly PA1 into the hook H1). The pin capturing system C1 is then operated to move the first pin retainer 40 to its second operative (locked) state so that the first pin assembly PA1 is captured in the first hook H1.

After the operator is certain that the ground crew is clear of the area near the attachment AT, the attachment AT is then lifted so that it hangs freely slightly off of the ground as shown in FIG. 7A. With reference to FIG. 7B, the arm 10 pivoted relative to a vertical plane V as indicated by the arrow A1 (i.e., the arm 10 is pivoted inwardly toward the machine to which it is connected) so that the second pin assembly PA2 goes through the vertical plane V moving inwardly toward the machine. The rod 18 of the cylinder 14 is then extended, so that the second hook H2 is located as shown at least partially vertically below the level of a horizontal plane passing through the center of the second pin assembly PA2 and also outward of the pin assembly PA2.

As shown in FIG. 7C, the arm 10 is then pivoted outwardly away from the machine in an opposite direction A2 through the vertical plane V, so that the pin assemblies PA1,PA2 pass through the vertical plane V and so that the hook H2 moves toward the pin assembly PA2. Those of ordinary skill in the art will recognize that the rod 18 is extended and/or retracted during this operation as necessary to control the position of the link 12, and the arm 10 is pivoted relative to the plane V to vary the angular position of the attachment AT relative to the arm 10 until the second pin assembly PA2 is located in contact with or at least adjacent the ramp 90 of the link 12 and, ultimately, is received fully in the hook H2 by sliding movement along the ramp 90 into the hook H2, i.e., the ramp 90 guides the pin assembly PA2 into the hook H2. In the case where access to the second pin assembly PA2 is somewhat limited by the presence of a box-type frame or the like, it is possible to vary the angular position of the attachment B as described in combination with movement of the link 12 so that the hook H2 is able to receive the pin assembly PA2 as required. Thereafter, the pin capturing system C2 is actuated to move the second pin capture member 140 from its first (unlocked) position to its second (locked) position to capture the second pin assembly PA2 in the hook H2 as shown in FIG. 7C. At this point, the operator or an assistant can insert the stop-pins SP into the second pin-receiving locations 60*b*,160*b* of the arm 10 and link 12, respectively, as shown in FIGS. 7D,7E if desired. It should be apparent from the foregoing that an arm assembly A formed in accordance with the present invention and operated according to the described coupling/decoupling method is advantageous owing to the fact that an operator can couple to or decouple from an associated attachment AT without assistance from a ground crew and without leaving the operator's cab of the excavator or other machine to which the arm assembly A is operatively connected. No mechanism is required to spread the hooks H1,H2 apart from each other to engage pin assemblies PA1,PA2, and the arm assembly A is not limited to use with pin assemblies PA1,PA2 that are spaced a set distance apart from each other, i.e., the arm assembly A is usable with different pin-to-pin spacings for pin assemblies PA1,PA2. As noted, decoupling of an associated attachment AT is preferably performed by reversing the above-described coupling method.

FIG. 7D shows an associated attachment AT operably coupled to the arm assembly A with the attachment in a first operative position often referred to as a roll-back or dump position. FIG. 7E is identical to FIG. 7D but shows the rod 18 of control cylinder 14 fully extended to move the attachment AT into a second operative position often referred to as a curled position.

Figure 8:
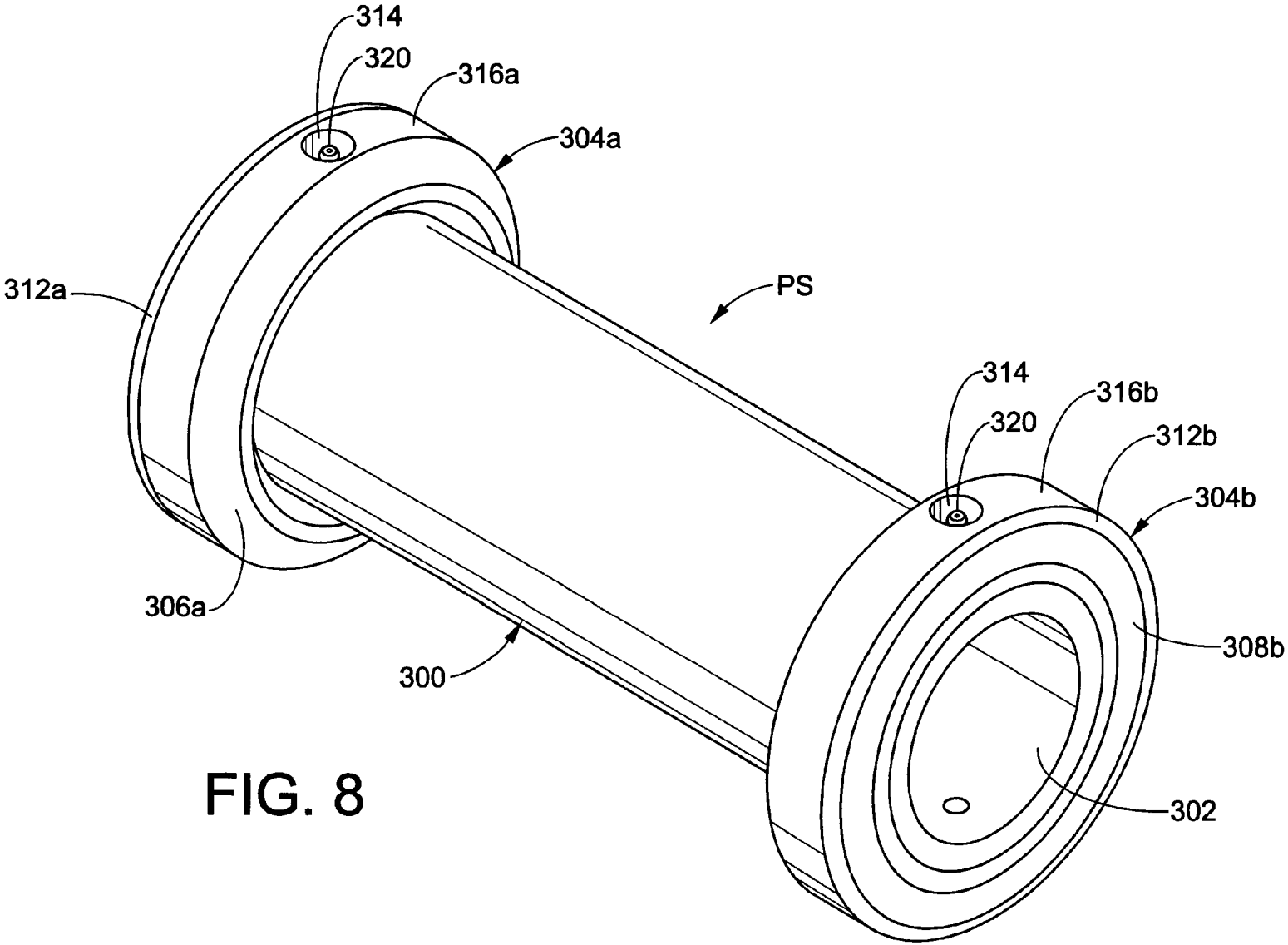
FIG. 8 is an isometric view of a pin sleeve formed in accordance with the present invention that is usable with the arm assembly of FIGS. 1A and 1B.

FIGS. 8 and 9 illustrate a sleeve member PS that is preferably used in connection with an arm assembly A formed in accordance with the present invention to account for different attachment pin lengths and diameters and also to improve overall performance. The sleeve PS comprises a cylindrical tubular member 300 defining a through-bore 302. First and second spacers 304*a*,304*b* are connected by welding or other means to or formed as a part of opposite first and second ends of the tubular member 300. As illustrated, the spacers 304*a*,304*b* define inner guide surfaces 306*a*,306*b* and outer bearing surfaces 308*a*,308*b*, respectively. The guide surfaces 306*a*,306*b* are beveled or otherwise are conformed to taper in a direction moving inwardly away from the bearing surface 308*a*,308*b*. The bearing surfaces 308*a*,308*b* are preferably planar. The spacers 304*a*,304*b* define respective grooves 310*a*,310*b* in which first and second O-ring seals 312*a*,312*b* are received so that the O-ring seals extend axially outward beyond bearing surfaces 308*a*,308*b*, respectively. Each spacer 304*a*,304*b* includes or defines at least one lubrication channel 314 that extends between the respective outer surface 316*a*,316*b* and the bore 302, axially inward of (between) the O-ring seals 312*a*, 312*b*. Conventional grease fittings 320 are installed in the lubrication channels 314.

As noted, the attachment AT (FIG. 1C) comprises first and second pin assemblies PA1,PA2 each comprising a sleeve PS. As shown in FIG. 9, the pin assembly PA2 comprises a sleeve PS coaxially secured about a conventional attachment pin P2. The conventional pin P2 is connected to and extends between first and second parallel spaced-apart ribs R1,R2 of the attachment AT. The sleeve PS is coaxially arranged with the pin P2 so that the pin P2 extends through the bore 302. The pin P2 is non-rotatably secured to the ribs R1,R2 by pin holders PH2*a*,PH2*b*. The sleeve PS is conformed and dimensioned so that it fits closely between ribs R1,R2 with the seals 312*a*,312*b* sealingly engaged with the ribs R1,R2, respectively, for a particular attachment or class of attachments. Also, the bore 302 is conformed and dimensioned so that the conventional attachment pin P2 is closely slidably received therein with minimal space between these two components. With the sleeve PS operatively positioned, the bearing surfaces 308*a*,308*b* lie adjacent and slidably contact ribs R1,R2. Although not shown in detail, the pin assembly PA1 includes a sleeve PS connected to a conventional attachment pin P1 and is otherwise structured in the same manner as the pin assembly PA2.

When installed as shown in FIG. 9, the sleeve PS is freely rotatable relative to the conventional pin P2. Lubrication such as grease can be introduced into the through-bore 302 via fittings 320 and channels 314. The O-rings 312*a*,312*b* confine the grease to the bore 302 and to the area between bearing surfaces 308*a*,308*b* and ribs R1,R2, while preventing or at least inhibiting entry of dirt, water and other contaminants into these same areas.

The tubular portions 300 of the sleeves PS are received into and captured in hooks H1,H2. This arrangement allows for the hooks H1,H2 to have fixed widths while different lengths of sleeves PS corresponding to different spacings between attachment ribs R1,R2 of various classes of OEM attachments AT are used together with conventional attachment pins P1,P2 to adapt a conventional attachment AT for being coupled to the arm assembly A. The sleeves PS of pin assemblies PA1,PA2 are non-rotatably held in the hooks H1,H2 of arm assembly A so that no lubrication is required at this interface and so that sleeves PS rotate about the conventional pins P1,P2 where sufficient lubrication and cleanliness are ensured. The bearing surfaces 308*a*,308*b* engage the ribs R1,R2, respectively, and rotate relative thereto with minimal wear owing to the large surface area, lubrication and relative cleanliness owing to seals 312*a*, 312*b*. The sleeves PS are easily replaced when worn.

It should also be noted that the use of the sleeves PS as described reduces the cost and assembly time for the link 12 and arm 10 in that the non-rotatable interfaces between the link 12 and the sleeve PS and arm 10 and sleeve PS do not require expensive and time consuming machining operations as would be required for a rotatable interface. Also, there is minimal wear at the interface between hooks H1,H2 and pin assemblies PA1,PA2 owing to the lack of rotation between these components.

Figure 10A:
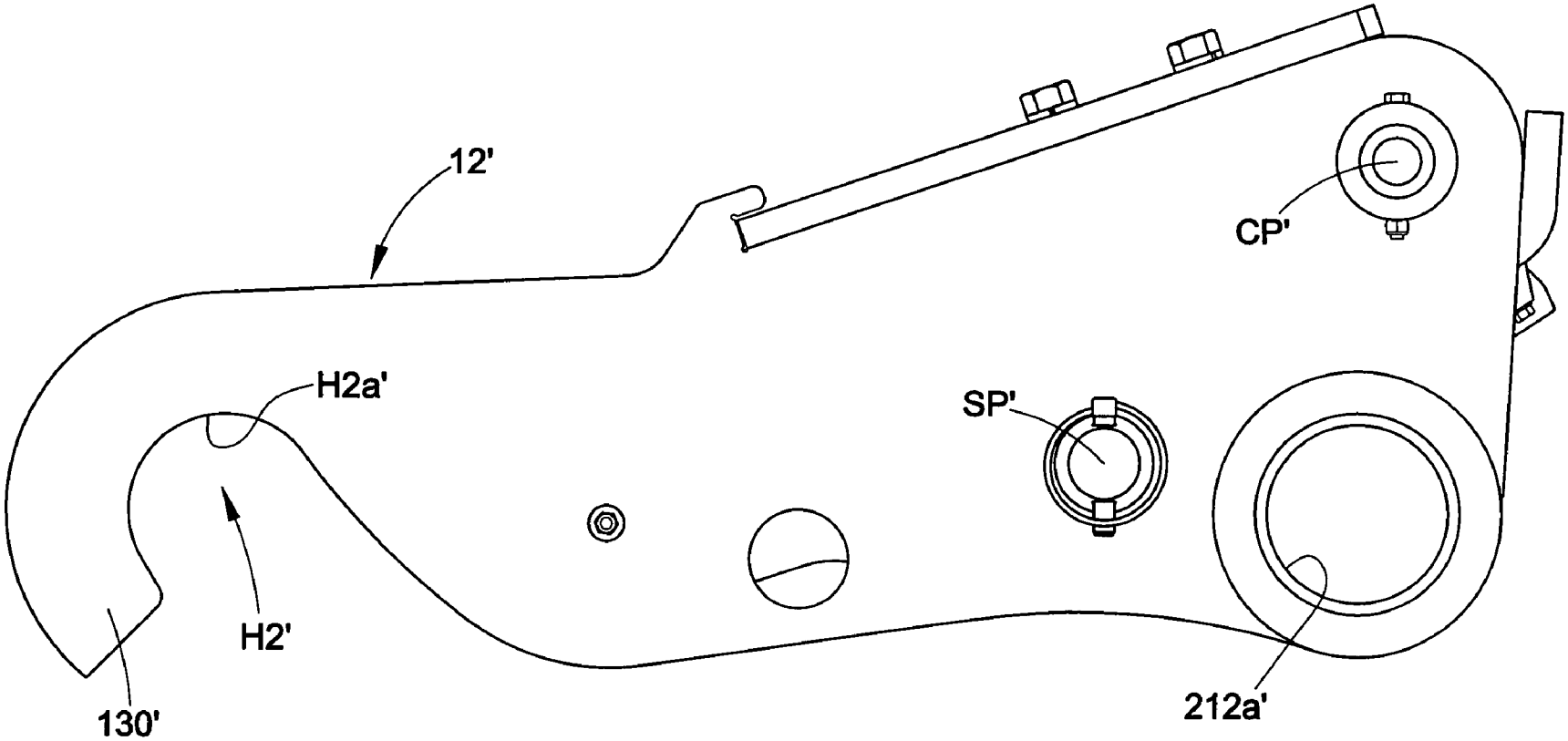
FIGS. 10A and 10B are side elevational views of an alternative control link formed in accordance with the present invention.
Figure 10B:
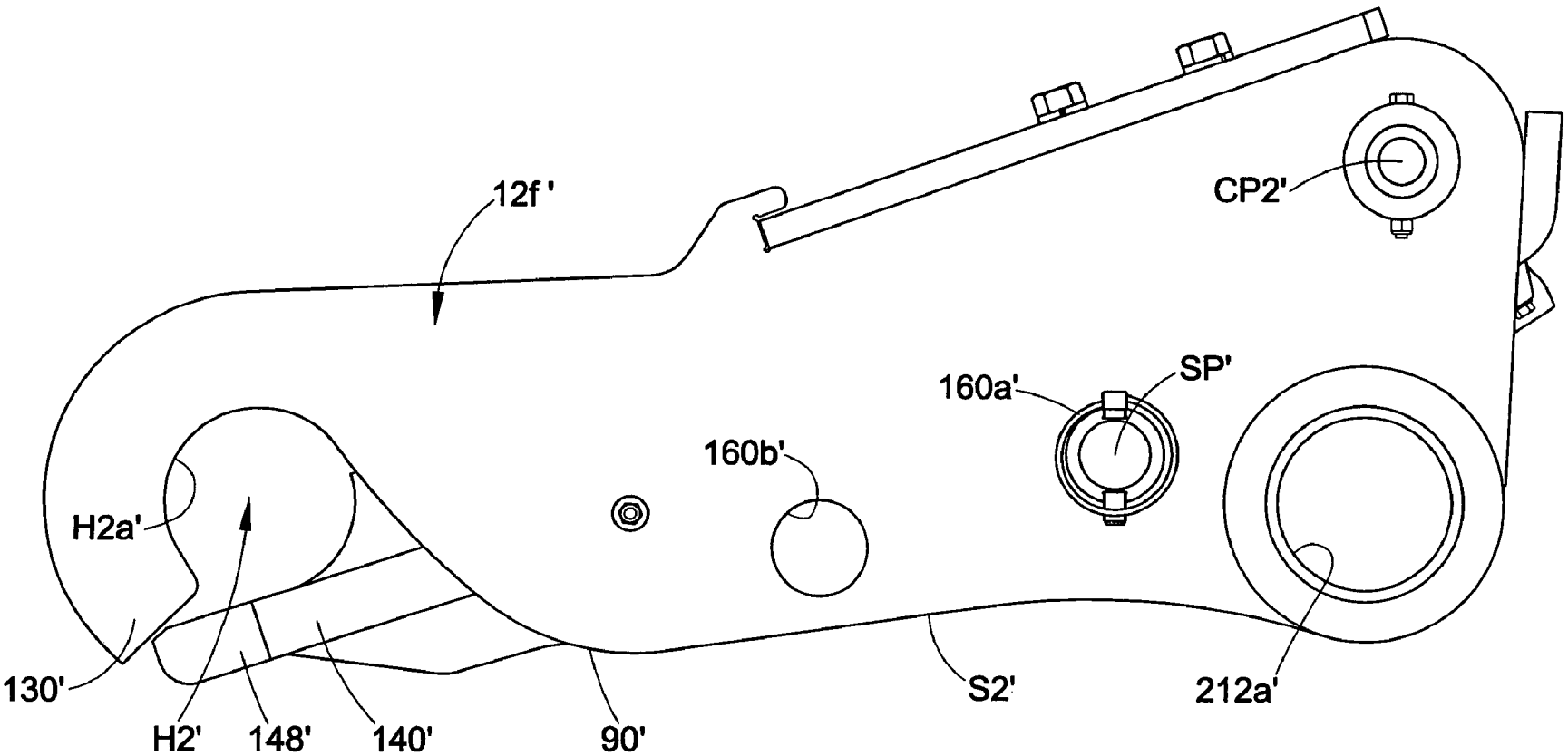

FIGS. 10A and 10B illustrate an alternative link 12' that can be used as an alternative to the link 12 in the arm assembly A. Except as shown and/or described, the link 12' is identical to the link 12 and like reference numerals including a primed (') designation are used to identify like components relative to the link 12. Unlike the link 12, the link 12' the tip 130' is shortened and made from thicker and stronger steel. The tip 130' does not include a slot that receives the tip 148' of second pin retainer 140'. As such, under certain conditions, the tip 130' has been found to have increased resistance to deformation relative to the tip 130 including the slot 132. When the second pin retainer 140' is extended to its second operative position as shown in FIG. 10B, the tip 148' thereof abuts tip 130' but is not otherwise engaged therewith.

The invention has been described with reference to preferred embodiments. Alterations and modifications will occur to those of ordinary skill in the art upon reading this specification, and it is intended that the claims be construed as encompassing all such modifications and alterations.

I claim:

1. An arm assembly for an excavator, said arm assembly comprising:

an arm comprising a first hook including a first open mouth, said arm further comprising a first pin capturing system that selectively obstructs the first open mouth;

a link movable relative to said arm and comprising a second hook including a second open mouth, said second open mouth oriented toward said arm, said link further comprising a second pin capturing system that selectively obstructs the second open mouth;

an attachment control cylinder operably coupled to said link for varying the position of said link relative to said arm; and, first and second guide links located on opposite sides of said arm, each of said guide links extending between and pivotally connected to said arm and said link.

2. The arm assembly as set forth in claim 1, wherein:

said first pin capturing system comprises: (i) a first pin-capturing member movably connected to said arm and movable between a first position where said first open mouth is configured to receive and release an associated attachment pin, and a second position, where said first pin-capturing member obstructs said first open mouth and captures an associated attachment pin in said first hook; and, (ii) a first hydraulic actuator operably coupled to said first pin-capturing member and operable to move said first pin-capturing member to and between its first and second positions; and, said second pin capturing system comprises: (i) a second pin-capturing member movably connected to said link and movable between a first position where said second open mouth is configured to receive and release an associated attachment pin, and a second position, where said second pin-capturing member obstructs said second open mouth and captures an associated attachment pin in said second hook; and, (ii) a second hydraulic actuator operably coupled to said second pin-capturing member and operable to move said second pin-capturing member to and between its first and second positions.

3. The arm assembly as set forth in claim 2, wherein said first and second pin capturing members are slidably movable between said first and second positions relative to said arm and link, respectively.

4. The arm assembly as set forth in claim 2, wherein said first and second hydraulic actuators comprise first and second hydraulic cylinders connected to said first and second pin-capturing members, respectively.

5. The arm assembly as set forth in claim 2, wherein:

a portion of said arm that defines said first hook comprises a first slot, and wherein said first pin-capturing member spans said first open mouth and comprises a first tip portion that is slidably received in said first slot when said first pin-capturing member is moved to said second position; and, a portion of said link that defines said second hook comprises a second slot, and wherein said second pin-capturing member spans said second open mouth and comprises a second tip portion that is slidably received in said second slot when said second pin-capturing member is moved to said second position.

6. The arm assembly as set forth in claim 5, wherein said first and second tip portions each comprise a wedge-shaped portion.

7. The arm assembly as set forth in claim 2 further comprising:

a stop pin, wherein said arm defines first and second receiving locations for said stop pin, and wherein said stop pin engages said first pin-capturing member and prevents movement of said first pin-capturing member from its second position to its first position when said stop pin is inserted in said second receiving location.

8. The arm assembly as set forth in claim 2 further comprising:

a stop pin, wherein said link defines first and second receiving locations for said stop pin, and wherein said stop pin engages said second pin-capturing member and prevents movement of said second pin-capturing member from its second position to its first position when said stop pin is inserted in said second receiving location.

9. The arm assembly as set forth in claim 2, wherein said link further comprises an inner surface oriented toward said arm and wherein said inner surface comprises an unobstruded ramp surface that blends said inner surface into said second hook.

10. The arm assembly as set forth in claim 2, wherein said second hook comprises an inner partially-cylindrical surface defined by a radius centered at an origin, said inner surface extending for not more than 180 degrees between first and second ends and comprising a mid-point that lies halfway between the first and second ends.

11. The arm assembly as set forth in claim 10, wherein:

said link comprises first and second opposite axial ends and wherein said first axial end comprises a pair of aligned bores defined about a pivot axis, said aligned bores defining a pin-on location for pivotally connecting said link to said attachment control cylinder; and, a hook angle of less than 90 degrees is defined between a first plane that passes through said mid-point and said origin, and a second plane that passes through said origin and said pivot axis.

12. The arm assembly as set forth in claim 1, wherein said link comprises a first axial end and a second axial end, said second hook is adjacent said second axial end, and wherein said second mouth is oriented toward said arm and angled toward said first axial end of said link.

13. The arm assembly as set forth in claim 1, wherein said arm further comprises an engagement point with which said second hook of said link is selectively engageable to prevent swinging of said link relative to said arm.

* * * * *